US011514844B2

(12) United States Patent
Xiao et al.

(10) Patent No.: US 11,514,844 B2
(45) Date of Patent: Nov. 29, 2022

(54) PIXEL DRIVE CIRCUIT, PIXEL UNIT, DRIVING METHOD, ARRAY SUBSTRATE, AND DISPLAY APPARATUS

(71) Applicant: BOE TECHNOLOGY GROUP CO., LTD., Beijing (CN)

(72) Inventors: Li Xiao, Beijing (CN); Minghua Xuan, Beijing (CN); Dongni Liu, Beijing (CN); Jing Liu, Beijing (CN); Qi Qi, Beijing (CN); Haoliang Zheng, Beijing (CN); Zhenyu Zhang, Beijing (CN); Liang Chen, Beijing (CN); Hao Chen, Beijing (CN)

(73) Assignee: Beijing BOE Technology Development Co., Ltd., Beijing (CN)

( * ) Notice: Subject to any disclaimer, the term of this patent is extended or adjusted under 35 U.S.C. 154(b) by 0 days.

(21) Appl. No.: 17/424,408

(22) PCT Filed: Sep. 10, 2020

(86) PCT No.: PCT/CN2020/114299

§ 371 (c)(1),
(2) Date: Jul. 20, 2021

(87) PCT Pub. No.: WO2021/047562

PCT Pub. Date: Mar. 18, 2021

(65) Prior Publication Data

US 2022/0101780 A1 Mar. 31, 2022

(30) Foreign Application Priority Data

Sep. 12, 2019 (WO) ..... PCT/CN2019/105759
Nov. 1, 2019 (CN) ..... 201911062037.6

(51) Int. Cl.
*G09G 3/32* (2016.01)

(52) U.S. Cl.
CPC ..... *G09G 3/32* (2013.01); *G09G 2300/0842* (2013.01); *G09G 2310/0278* (2013.01); *G09G 2320/0233* (2013.01)

(58) Field of Classification Search
CPC ..... G09G 3/32; G09G 2300/0842; G09G 2310/0278; G09G 2320/0233
See application file for complete search history.

(56) References Cited

U.S. PATENT DOCUMENTS 9,230,481 B2 1/2016 Tseng et al.
2014/0084932 A1 3/2014 Chaji et al.
(Continued)

FOREIGN PATENT DOCUMENTS

CN 102982766 A 3/2013
CN 105913801 A 8/2016
(Continued)

OTHER PUBLICATIONS

The First Office Action of Priority Application No. CN 201910059510.9 issued by the Chinese Patent Office dated Dec. 25, 2019.
(Continued)

*Primary Examiner* — Kenneth B Lee, Jr.
(74) *Attorney, Agent, or Firm* — IP & T Group LLP

(57) ABSTRACT

A pixel drive circuit includes a data write sub-circuit, an input and read sub-circuit, a drive sub-circuit, and a first output control sub-circuit. The data write sub-circuit is configured to transmit data signals input from a first data voltage terminal at different times to a first node. The input and read sub-circuit is configured to: transmit a signal of a signal transmission terminal to a second node in a write period, and transmit an electrical signal of the second node to the signal transmission terminal in a threshold voltage read period. The drive sub-circuit is configured to output a drive signal. The first output control sub-circuit is configured
(Continued)

to: be coupled to an element to be driven, and transmit the drive signal output by the drive sub-circuit to the element to be driven.

16 Claims, 19 Drawing Sheets

(56) References Cited

U.S. PATENT DOCUMENTS

| | | | | |
|---|---|---|---|---|
| 2014/0252988 | A1 | 9/2014 | Azizi et al. | |
| 2014/0267215 | A1 | 9/2014 | Soni et al. | |
| 2015/0294626 | A1 | 10/2015 | Bi et al. | |
| 2016/0063921 | A1* | 3/2016 | Tsai | G09G 3/3233 345/76 |
| 2016/0155377 | A1* | 6/2016 | Kishi | G09G 3/3233 345/214 |
| 2016/0379570 | A1 | 12/2016 | Lee et al. | |
| 2017/0025063 | A1 | 1/2017 | Chaji | |
| 2017/0103703 | A1 | 4/2017 | Bi et al. | |
| 2017/0287398 | A1 | 10/2017 | Soni et al. | |
| 2017/0358251 | A1 | 12/2017 | Chaji | |
| 2019/0272785 | A1 | 9/2019 | Qian | |
| 2019/0304362 | A1 | 10/2019 | Yuan et al. | |
| 2020/0043417 | A1 | 2/2020 | Yang et al. | |
| 2021/0201760 | A1 | 7/2021 | Wang et al. | |
| 2021/0201776 | A1 | 7/2021 | Yuan et al. | |
| 2021/0366396 | A1 | 11/2021 | Xuan et al. | |

FOREIGN PATENT DOCUMENTS

| | | | | | |
|---|---|---|---|---|---|
| CN | 106297666 | A | | 1/2017 | |
| CN | 107993614 | A | | 5/2018 | |
| CN | 108417169 | A | | 8/2018 | |
| CN | 108766349 | A | | 11/2018 | |
| CN | 109166528 | A | | 1/2019 | |
| CN | 109215569 | A | | 1/2019 | |
| CN | 109389937 | A | | 2/2019 | |
| CN | 109584788 | A | * | 4/2019 | G09G 3/32 |
| CN | 109584788 | A | | 4/2019 | |
| CN | 109872680 | A | * | 6/2019 | G09G 3/32 |
| CN | 109872680 | A | | 6/2019 | |
| CN | 110021263 | A | | 7/2019 | |
| WO | 2014/141156 | A1 | | 9/2014 | |
| WO | 2020/007024 | A1 | | 1/2020 | |

OTHER PUBLICATIONS

The Second Office Action of Priority Application No. CN 201910059510.9 issued by the Chinese Patent Office dated Jul. 7, 2020.

Decision of Rejection of Priority Application No. CN 201910059510.9 issued by the Chinese Patent Office dated Nov. 27, 2020.

International Search Report and Written Opinion of Priority Application No. PCT/CN2019/105759 issued by the Chinese Patent Office dated Dec. 12, 2019.

Office Action of U.S. Appl. No. 16/639,066 issued by the USPTO dated Nov. 1, 2021.

The First Office Action of Priority Application No. CN 201911062037.6 issued by the Chinese Patent Office dated Jul. 22, 2021.

Notice of Allowance for U.S. Appl. No. 16/639,066 issued by the USPTO dated Mar. 30, 2022.

Notice of Allowance issued by the USPTO dated Mar. 30, 2022.

* cited by examiner

PIXEL DRIVE CIRCUIT, PIXEL UNIT, DRIVING METHOD, ARRAY SUBSTRATE, AND DISPLAY APPARATUS

CROSS-REFERENCE TO RELATED APPLICATIONS

This application is a national phase entry under 35 USC 371 of International Patent Application No. PCT/CN2020/114299 filed on Sep. 10, 2020, which claims priority to PCT Patent Application No. PCT/CN2019/105759, filed on Sep. 12, 2019, and Chinese Patent Application No. 201911062037.6, filed on Nov. 1, 2019, which are incorporated herein by reference in their entirety.

TECHNICAL FIELD

The present disclosure relates to the field of display technologies, in particular, to a pixel drive circuit, a pixel unit, a driving method, an array substrate, and a display apparatus.

BACKGROUND

With a rapid advancement of display technologies, a semiconductor element technology, which is a core technology of a display apparatus, has also made rapid progress. In the display apparatus, light-emitting diodes (LEDs), for example, micro light-emitting diodes (μLEDs) are integrated on one chip at high density to form a tiny-sized LED array, which may realize a thinning, miniaturization and matrixing of LEDs. However, threshold voltages of transistors used to drive the LED to emit light in the display apparatus will drift, thereby causing a phenomenon of uneven brightness of the display apparatus.

SUMMARY

In one aspect, a pixel drive circuit is provided. The pixel drive circuit includes a data write sub-circuit, an input and read sub-circuit, a drive sub-circuit, and a first output control sub-circuit. The data write sub-circuit is coupled to a first node, a first scan signal terminal, and a first data voltage terminal. The data write sub-circuit is configured to transmit data signals input from the first data voltage terminal at different times to the first node under control of a turn-on signal transmitted by the first scan signal terminal. The input and read sub-circuit is coupled to a second node, a first signal terminal and a signal transmission terminal. The input and read sub-circuit is configured to: transmit a signal of the signal transmission terminal to the second node under control of a turn-on signal transmitted by the first signal terminal in a write period, and transmit an electrical signal of the second node to the signal transmission terminal under the control of the turn-on signal transmitted by the first signal terminal in a threshold voltage read period. The drive sub-circuit is coupled to the first node, the second node, and a first voltage terminal. The drive sub-circuit is configured to output a drive signal under control of a signal of the first node, a signal of the second node, and a signal of the first voltage terminal. The first output control sub-circuit is coupled to the drive sub-circuit, and an enable signal terminal. The first output control sub-circuit is configured to: be coupled to an element to be driven, and transmit the drive signal output by the drive sub-circuit to the element to be driven under control of a turn-on signal transmitted by the enable signal terminal.

In some embodiments, the pixel drive circuit further includes a time control sub-circuit coupled to a second scan signal terminal, a third voltage terminal, a second data voltage terminal, and the first output control sub-circuit. The time control sub-circuit is configured to: be coupled to the element to be driven, store a signal of the second data voltage terminal under control of a turn-on signal transmitted by the second scan signal terminal, and control an operating time of the first output control sub-circuit and the element to be driven according to the signal of the second data voltage terminal.

In some embodiments, the time control sub-circuit includes a fifth transistor, a sixth transistor, and a second storage capacitor. A gate of the fifth transistor is coupled to the second scan signal terminal, and a first electrode of the fifth transistor is coupled to the second data voltage terminal, a second electrode of the fifth transistor is coupled to a first terminal of the second storage capacitor and a gate of the sixth transistor. A first electrode of the sixth transistor is coupled to the first output control sub-circuit, a second electrode of the sixth transistor is configured to be coupled to the element to be driven. A second terminal of the second storage capacitor is coupled to the third voltage terminal.

In some embodiments, the first output control sub-circuit includes a third transistor. A gate of the third transistor is coupled to the enable signal terminal, a first electrode of the third transistor is coupled to the drive sub-circuit, and a second electrode of the third transistor is configured to be coupled to the element to be driven.

In some embodiments, the pixel drive circuit further includes a second output control sub-circuit coupled to the first voltage terminal, the drive sub-circuit, and the enable signal terminal. The second output control sub-circuit is configured to transmit the signal of the first voltage terminal to the drive sub-circuit under the control of the turn-on signal transmitted by the enable signal terminal.

In some embodiments, the second output control sub-circuit includes a fourth transistor. A gate of the fourth transistor is coupled to the enable signal terminal, a first electrode of the fourth transistor is coupled to the first voltage terminal, and a second electrode of the fourth transistor is coupled to the drive sub-circuit.

In some embodiments, the data write sub-circuit includes a first transistor. A gate of the first transistor is coupled to the first scan signal terminal, a first electrode of the first transistor is coupled to the first data voltage terminal, and a second electrode of the first transistor is coupled to the first node.

In some embodiments, the input and read sub-circuit includes a second transistor. A gate of the second transistor is coupled to the first signal terminal, a first electrode of the second transistor is coupled to the signal transmission terminal, and a second electrode of the second transistor is coupled to the second node.

In some embodiments, the drive sub-circuit includes a first storage capacitor and a drive transistor. A first terminal of the first storage capacitor is coupled to the first node, and a second terminal of the first storage capacitor is coupled to the second node. A gate of the drive transistor is coupled to the first node. A first electrode of the drive transistor is coupled to the first voltage terminal, and a second electrode of the drive transistor is coupled to the second node and the first output control sub-circuit.

In some embodiments, the drive sub-circuit includes a first storage capacitor and a drive transistor. A first terminal of the first storage capacitor is coupled to the first node, and a second terminal of the first storage capacitor is coupled to the second node. A gate of the drive transistor is coupled to the first node. A first electrode of the drive transistor is coupled to the second output control sub-circuit, a second electrode of the drive transistor is coupled to the second node and the first output control sub-circuit; or a first electrode of the drive transistor is coupled to the second node and the second output control sub-circuit, and a second electrode of the drive transistor is coupled to the first output control sub-circuit.

In another aspect, a pixel unit is provided. The pixel unit includes the element to be driven and the pixel drive circuit as described in any one of the above embodiments. The element to be driven is coupled to a second voltage terminal and the first output control sub-circuit of the pixel drive circuit. The element to be driven is configured to emit light under driving of the drive signal output by the pixel drive circuit through a signal path closed between the first voltage terminal and the second voltage terminal.

In some embodiments, the element to be driven includes a light-emitting diode.

In yet another aspect, an array substrate is provided. The array substrate includes a plurality of read signal lines, a plurality of transmission circuits, and a plurality of pixel units as described in any of the above embodiments arranged in a matrix. Signal transmission terminals of pixel units located in a same column are coupled to a read signal line of the plurality of read signal lines, and the read signal line is coupled to a transmission circuit of the plurality of transmission circuits. The transmission circuit is configured to: input an initialization signal to a signal transmission terminal of each pixel unit of the pixel units located in the same column through the read signal line in the write period, and read a signal from the signal transmission terminal through the read signal line in the threshold voltage read period.

In some embodiments, the transmission circuit includes a seventh transistor. A gate of the seventh transistor is coupled to a second signal terminal, a first electrode of the seventh transistor is coupled to the read signal line, a second electrode of the seventh transistor is configured to: receive the initialization signal under control of a signal of the second signal terminal in the write period, and output the signal of the read signal line in the threshold voltage read period. Or, the transmission circuit includes an eighth transistor and a ninth transistor. A gate of the eighth transistor is coupled to a third signal terminal, a first electrode of the eighth transistor is coupled to the read signal line, and a second electrode of the eighth transistor is configured to receive the initialization signal under control of a signal of the third signal terminal in the write period. A gate of the ninth transistor is coupled to a fourth signal terminal, a first electrode of the ninth transistor is coupled to the read signal line, and a second electrode of the ninth transistor is configured to output the signal of the read signal line under control of a signal of the fourth signal terminal in the threshold voltage read period.

In yet another aspect, a display apparatus is provided. The display apparatus includes an integrated circuit and the array substrate as described in any one of the above embodiments. The integrated circuit is coupled to the read signal lines in the array substrate. The array substrate further includes a plurality of data lines coupled to the integrated circuit, and in the array substrate, data write sub-circuits of the pixel units located in the same column are coupled to a data line of the plurality of data lines. The integrated circuit is configured to: receive a signal of the read signal line, obtain a threshold voltage of a drive sub-circuit in the pixel unit, generate a compensated data signal, and transmit the compensated data signal to the data write sub-circuit through the data line in the threshold voltage read period.

In some embodiments, the array substrate further includes a plurality of first scan signal lines, a plurality of enable signal lines and a plurality of second scan signal lines. Pixel drive circuits of pixel units located in a same row are coupled to a same first scan signal line, a same enable signal line, and a same second scan signal line.

In yet another aspect, a method of driving a pixel unit is provided. The pixel unit includes a pixel drive circuit and an element to be driven. The pixel drive circuit includes a data write sub-circuit, an input and read sub-circuit, a drive sub-circuit, a first output control sub-circuit, and a time control sub-circuit. The data write sub-circuit is coupled to a first node, a first scan signal terminal and a first data voltage terminal. The input and read sub-circuit is coupled to a second node, a first signal terminal and a signal transmission terminal. The drive sub-circuit is coupled to the first node, the second node and a first voltage terminal. The first output control sub-circuit is coupled to the drive sub-circuit, the element to be driven and an enable signal terminal. The time control sub-circuit is coupled to a second scan signal terminal, a third voltage terminal, a second data voltage terminal, the first output control sub-circuit and the element to be driven. The element to be driven is coupled to the first output control sub-circuit and a second voltage terminal. A display period of the pixel unit includes a write period, a time control period, and a light-emitting period. The driving method includes:

in the write period, transmitting, by the data write sub-circuit, a data signal input from the first data voltage terminal to the first node under control of a turn-on signal transmitted by the first scan signal terminal; and transmitting, by the input and read sub-circuit, a signal of the signal transmission terminal to the second node under control of a turn-on signal transmitted by the first signal terminal to initialize the second node;

in the time control period, storing, by the time control sub-circuit, a signal of the second data voltage terminal under control of a turn-on signal transmitted by the second scan signal terminal; and in the light-emitting period, outputting, by the drive sub-circuit, a drive signal under control of a signal of the first node, a signal of the second node, and a signal of the first voltage terminal; controlling, by the time control sub-circuit, an operating time of the first output control sub-circuit and the element to be driven according to the signal of the second data voltage terminal, so as to control a time during which a signal path is closed between the first voltage terminal and the second voltage terminal; receiving, by the element to be driven, the drive signal transmitted in the signal path to emit light under driving of the drive signal.

In some embodiments, a signal of the enable signal terminal is a first pulse signal including a plurality of continuous pulses with different periods. The signal of the second data voltage terminal is a second pulse signal. Controlling, by the time control sub-circuit, the operating time of the first output control sub-circuit and the element to be driven according to the signal of the second data voltage terminal includes: selecting, by the time control sub-circuit, at least a portion of the first pulse signal as an effective signal for turning on the first output control sub-circuit according to a duty ratio of the second pulse signal, so as to control the time during which the signal path is closed between the first voltage terminal and the second voltage terminal.

In some embodiments, a non-display period other than the display period of the pixel unit includes an initialization period, a threshold voltage write period, and a threshold voltage read period, the driving method further includes:

in the initialization period, receiving, by the signal transmission terminal, an initialization signal; and transmitting, by the input and read sub-circuit, the initialization signal to the second node under the control of the turn-on signal transmitted by the first signal terminal to initialize the second node;

in the threshold voltage write period, stopping, by the signal transmission terminal, receiving the initialization signal; and transmitting, by the first voltage terminal, a display data signal and a threshold voltage of the drive sub-circuit to the second node through the drive sub-circuit; and in the threshold voltage read period, receiving, by the signal transmission terminal, a voltage of the second node to obtain a threshold voltage and generate a compensated display data signal; and transmitting, by the data write sub-circuit, the compensated display data signal input from the data voltage terminal to the first node under the control of the turn-on signal transmitted by the first scan signal terminal.

In yet another aspect, a method of driving a pixel unit is provided. The pixel unit includes a pixel drive circuit and an element to be driven. The pixel drive circuit includes a data write sub-circuit, an input and read sub-circuit, a drive sub-circuit and a first output control sub-circuit. The data write sub-circuit is coupled to a first node, a first scan signal terminal, and a first data voltage terminal. The input and read sub-circuit is coupled to a second node, a first signal terminal a signal transmission terminal. The drive sub-circuit is coupled to the first node, the second node and a first voltage terminal. The first output control sub-circuit is coupled to the drive sub-circuit, the element to be driven and an enable signal terminal. The element to be driven is coupled to the first output control sub-circuit and a second voltage terminal.

The driving method includes:

in an initialization period, transmitting, by the data write sub-circuit, a first initialization data signal input from the first data voltage terminal to the first node under control of a turn-on signal transmitted by the first scan signal terminal; and transmitting, by the input and read sub-circuit, a second initialization data signal input from the signal transmission terminal to the second node under control of a turn-on signal transmitted by the first signal terminal;

in a threshold voltage read period, transmitting, by the data write sub-circuit, a first data signal input from the first data voltage terminal to the first node under the control of the turn-on signal transmitted by the first scan signal terminal; and transmitting, by the input and read sub-circuit, an electrical signal of the second node to the signal transmission terminal under the control of the turn-on signal transmitted by the first signal terminal;

in a threshold voltage compensation period, transmitting, by the data write sub-circuit, a second data signal input from the first data voltage terminal to the first node under the control of the turn-on signal transmitted by the first scan signal terminal, and storing the second data signal in the drive sub-circuit, the second data signal being a signal obtained by compensating the first data signal; and receiving, by the signal transmission terminal, a signal of the second voltage terminal, and transmitting, by the input and read sub-circuit, a potential signal input from the signal transmission terminal to the second node under the control of the turn-on signal transmitted by the first signal terminal; and in a light-emitting period, controlling, by the first output control sub-circuit, a signal path to be closed between the first voltage terminal and the second voltage terminal under control of a turn-on signal transmitted by the enable signal terminal; transmitting, by the first output control sub-circuit, a signal of the first voltage terminal to the drive sub-circuit; outputting, by the drive sub-circuit, a drive signal under control of a signal of the first node, a signal of the second node, and the signal of the first voltage terminal; and receiving, by the element to be driven, the drive signal transmitted in the signal path to emit light under driving of the drive signal.

BRIEF DESCRIPTION OF THE DRAWINGS

In order to describe technical solutions in the present disclosure more clearly, accompanying drawings to be used in some embodiments of the present disclosure will be introduced briefly below. Obviously, the accompanying drawings to be described below are merely accompanying drawings of some embodiments of the present disclosure, and a person of ordinary skill in the art may obtain other drawings according to these drawings. In addition, the accompanying drawings to be described below may be regarded as schematic diagrams, and are not limitations on an actual size of a product, an actual process of a method and an actual timing of a signal involved in the embodiments of the present disclosure.

DETAILED DESCRIPTION

Figure 1A:
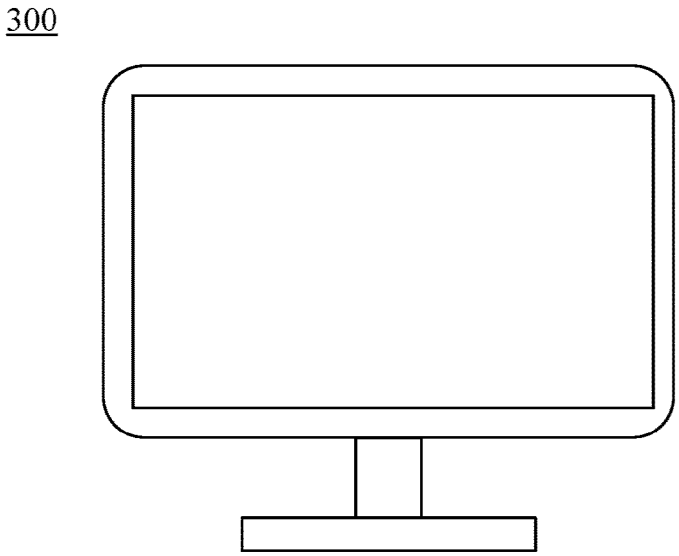
FIG. 1A is a structural diagram of a display apparatus, in accordance with some embodiments.

Technical solutions in some embodiments of the present disclosure will be described clearly and completely with reference to accompanying drawings below. Obviously, the described embodiments are merely some but not all embodiments of the present disclosure. All other embodiments obtained on the basis of the embodiments of the present disclosure by a person of ordinary skill in the art shall be included in the protection scope of the present disclosure.

Unless the context requires otherwise, throughout the description and the claims, the term "comprise" and other forms thereof such as the third-person singular form "comprises" and the present participle form "comprising" are construed as open and inclusive, i.e., "including, but not limited to." In the description of the specification, the terms such as "one embodiment", "some embodiments", "exemplary embodiments", "example", "specific example" or "some examples" are intended to indicate that specific features, structures, materials or characteristics related to the embodiment(s) or example(s) are included in at least one embodiment or example of the present disclosure. Schematic representations of the above terms do not necessarily refer to the same embodiment(s) or example(s). In addition, the specific features, structures, materials, or characteristics described herein may be included in any one or more embodiments or examples in any suitable manner.

Hereinafter, the terms "first" and "second" are used for descriptive purposes only, and are not to be construed as indicating or implying relative importance or implicitly indicating the number of indicated technical features. Thus, features defined with "first" or "second" may explicitly or implicitly include one or more of the features. In the description of the embodiments of the present disclosure, the term "a plurality of/the plurality of" means two or more unless otherwise specified.

In the description of some embodiments, the terms such as "couple" and "connect" and their extensions may be used. For example, the term "connect" may be used in the description of some embodiments to indicate that two or more components are in direct physical or electrical contact with each other. For another example, the term "couple" may be used in the description of some embodiments to indicate that two or more components are in direct physical or electrical contact. However, the term "couple" or "communicatively couple" may also mean that two or more components are not in direct contact with each other, but still cooperate or interact with each other. The embodiments disclosed herein are not necessarily limited to the contents herein.

The phrase "A and/or B" includes the following three combinations: only A, only B, and a combination of A and B.

The use of the phrase "applicable to" or "configured to" means an open and inclusive express, which does not exclude apparatuses that are applicable to or configured to perform additional tasks or steps.

In addition, the use of "based on" means openness and inclusiveness, because processes, steps, calculations or other actions "based on" one or more of the stated conditions or values may be based on additional conditions or exceed the stated values in practice.

Some embodiments of the present disclosure provide a display apparatus 300. The display apparatus 300 may be, for example, a television (shown in FIG. 1A), a mobile phone, a tablet computer, a personal digital assistant (PDA) and a vehicle-mounted computer. Embodiments of the present disclosure do not specifically limit a specific form of the display apparatus 300.

Figure 1B:
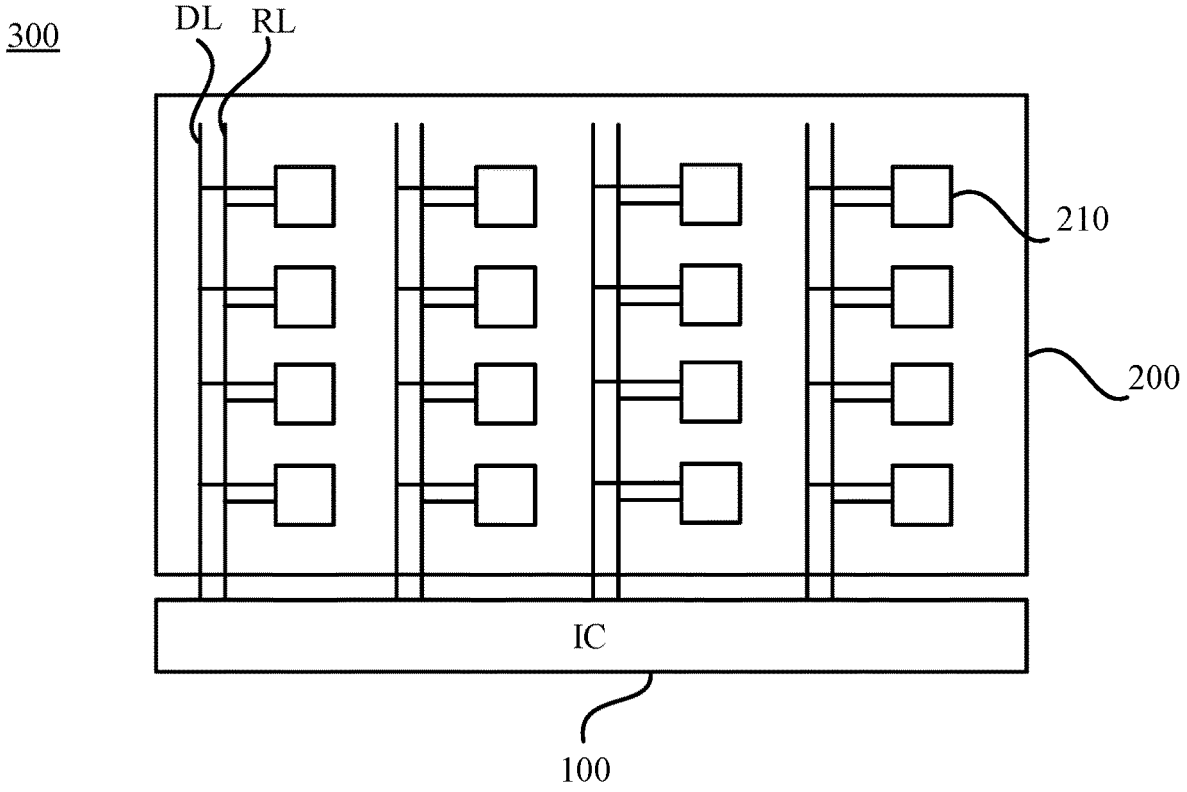
FIG. 1B is a structural diagram of another display apparatus, in accordance with some embodiments.

In some embodiments, as shown in FIG. 1B, the display apparatus 300 includes an integrated circuit (IC) 100 and an array substrate 200. The integrated circuit 100 may be a display driver IC (DDIC). The array substrate 200 includes a plurality of read signal lines RL and a plurality of data lines DL, and each data line DL and each read signal line RL are coupled to the IC.

As shown in FIG. 1B, the array substrate 200 further includes a plurality of pixel units 210 arranged in a matrix. Each pixel unit 210 is coupled to one read signal line RL and one data line DL. The IC 100 may receive a data signal that is related to a threshold voltage and output by the pixel unit 210 through the read signal line RL, or input a data signal to the pixel unit 210 through the data line DL, so as to control each pixel unit 210.

Figure 2:
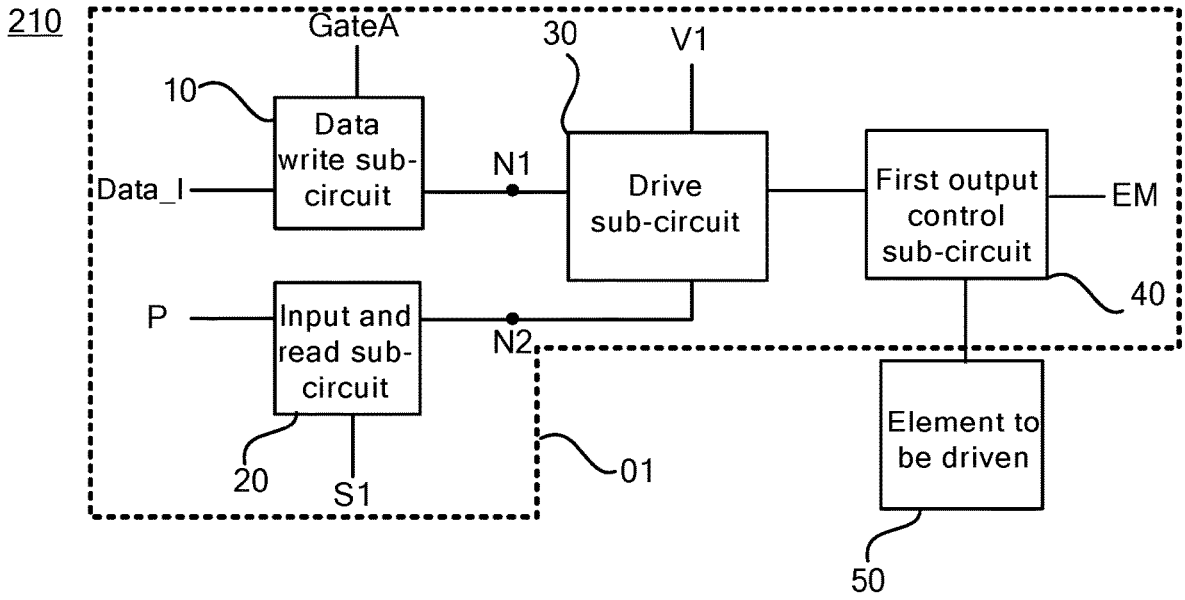
FIG. 2 is a circuit structural diagram of a pixel unit, in accordance with some embodiments.

In some embodiments, the pixel unit 210 includes a pixel drive circuit 01 and an element 50 to be driven coupled to the pixel drive circuit 01 as shown in FIG. 2. The element 50 to be driven is a current-type drive device, and further, may be a current-type light-emitting diode, for example, a micro light-emitting diode (Micro LED), a mini light-emitting diode (Mini LED), or an organic light-emitting diode (OLED). In this case, an operating time described in the contents herein may be understood as light-emitting duration of the element 50 to be driven. The element 50 to be driven may be a light-emitting device (e.g., a light-emitting diode), and a first electrode and a second electrode of the element 50 to be driven may be respectively an anode and a cathode of the light-emitting diode.

A structure of the pixel drive circuit 01 provided by some embodiments of the present disclosure will be described in detail below.

As shown in FIG. 2, the pixel drive circuit 01 includes a data write sub-circuit 10, an input and read sub-circuit 20, a drive sub-circuit 30 and a first output control sub-circuit 40.

The data write sub-circuit 10 is coupled to a first node N1, a first scan signal terminal GateA and a first data voltage terminal Data_I. The data write sub-circuit 10 is configured to transmit data signals input from the first data voltage terminal Data_I at different times to the first node N1 under control of a turn-on signal transmitted by the first scan signal terminal GateA.

The input and read sub-circuit 20 is coupled to a second node N2, a first signal terminal S1 and a signal transmission terminal P. The input and read sub-circuit 20 is configured to transmit a signal of the signal transmission terminal P to the second node N2 under control of a turn-on signal transmitted by the first signal terminal S1 when the pixel drive circuit is in a write period. Or, the input and read sub-circuit 20 is further configured to transmit an electrical signal of the second node N2 to the signal transmission terminal P under the control of the turn-on signal transmitted by the first signal terminal S1 when the pixel drive circuit is in a threshold voltage read period.

It can be noted that the write period is a period in which the signal provided by the signal transmission terminal P is written to the second node N2. In addition, the threshold voltage read period is a period in which when the electrical signal of the second node N2 includes a threshold voltage Vth of a drive transistor in the drive sub-circuit 30, the electrical signal of the second node N2 is read and transmitted to the driver IC, for example, DDIC, so that the threshold voltage Vth is transmitted to the first data voltage terminal Data_I through an external compensation.

The signals received by the first signal terminal S1 and the first scan signal terminal GateA may be the same or different. In a case where active level periods and inactive level periods of the signals received by the first signal terminal S1 and the first scan signal terminal GateA are the same, the first signal terminal S1 and the first scan signal terminal GateA may be connected to a same signal input terminal. That is, the signals received by the first signal terminal S1 and the first scan signal terminal GateA are synchronized.

In addition, as shown in FIG. 2, the drive sub-circuit 30 is coupled to the first node N1, the second node N2, and a first voltage terminal V1. The drive sub-circuit 30 is configured to output a drive signal under control of a signal of the first node N1, a signal of the second node N2, and a signal of the first voltage terminal V1. It can be seen from the above that the drive signal may be a current drive signal to drive the element 50 to be driven shown in FIG. 2, for example, to drive a μLED to emit light.

The first output control sub-circuit 40 is coupled to the drive sub-circuit 30, the element 50 to be driven, and an enable signal terminal EM. The first output control sub-circuit 40 is configured to transmit the drive signal output by the drive sub-circuit 30 to the element 50 to be driven under control of a turn-on signal transmitted by the enable signal terminal EM, so that the pixel drive circuit 01 may drive the element 50 to be driven (e.g., the light-emitting diode) to emit light.

It can be seen from the above that the element 50 to be driven is driven by the drive current generated by the drive sub-circuit 30. Before the drive current is generated, a threshold voltage of the drive sub-circuit 30 is obtained through the input and read sub-circuit 20, and the threshold voltage of the drive sub-circuit 30 is cancelled out, so that the drive current flowing through the element 50 to be driven is independent of the threshold voltage Vth of the drive transistor in the drive sub-circuit 30, which may improve a display brightness difference caused by variation of threshold voltage drift of the pixel drive circuit.

A specific structure of each sub-circuit in the pixel drive circuit 01 shown in FIG. 2 is described in detail below.

Figure 3:
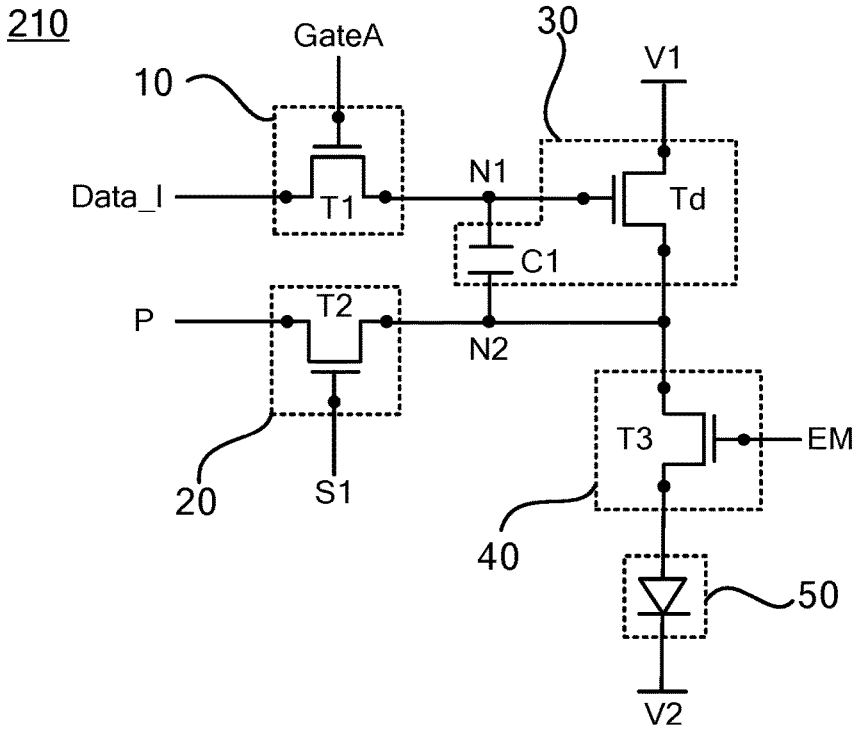
FIG. 3 is an equivalent circuit diagram of another pixel unit, in accordance with some embodiments.

In some embodiments, as shown in FIG. 3, the data write sub-circuit 10 includes a first transistor T1.

A gate of the first transistor T1 is coupled to the first scan signal terminal GateA, a first electrode of the first transistor T1 is coupled to the first data voltage terminal Data_I, a second electrode of the first transistor T1 is coupled to the first node N1.

It can be noted that the data write sub-circuit 10 may further include a plurality of switching transistors connected in parallel with the first transistor T1. The above is merely an example of the data write sub-circuit 10. Other structures with a same function as the data write sub-circuit 10 are not repeated herein, but all shall be included in the protection scope of the present disclosure.

In some embodiments, as shown in FIG. 3, the input and read sub-circuit 20 includes a second transistor T2.

A gate of the second transistor T2 is coupled to the first signal terminal S1, a first electrode of the second transistor T2 is coupled to the signal transmission terminal P, and a second electrode of the second transistor T2 is coupled to the second node N2.

It can be noted that the input and read sub-circuit 20 may further include a plurality of switching transistors connected in parallel with the second transistor T2. The above is merely an example of the input and read sub-circuit 20, and other structures with a same function as the input and read sub-circuit 20 will not be repeated herein, but shall all be included in the protection scope of the present disclosure.

In some embodiments, as shown in FIG. 3, the drive sub-circuit 30 includes a first storage capacitor C1 and a drive transistor Td.

A first terminal of the first storage capacitor C1 is coupled to the first node N1, and a second terminal of the storage capacitor C1 is coupled to the second node N2.

A gate of the drive transistor Td is coupled to the first node N1, a first electrode of the drive transistor Td is coupled to the first voltage terminal V1, and a second electrode of the drive transistor Td is coupled to the second node N2 and the first output control circuit 40.

The drive transistor Td is a transistor that provides the drive current to the element 50 to be driven, and the drive transistor Td has a certain load capacity. In some embodiments of the present disclosure, a width-to-length ratio of the drive transistor Td may be greater than a width-to-length ratios of other transistors.

It can be noted that the drive sub-circuit 30 may further include a plurality of transistors connected in parallel with the drive transistor Td. The above is merely an example of the drive sub-circuit 30, other structures with a same function as the drive sub-circuit 30 are not repeated herein, but all shall be included in the protection scope of the present disclosure.

In some embodiments, as shown in FIG. 3, the first output control sub-circuit 40 includes a third transistor T3.

A gate of the third transistor T3 is coupled to the enable signal terminal EM, a first electrode of the third transistor T3 is coupled to the drive sub-circuit 30, a second electrode of the third transistor T3 is coupled to the element 50 to be driven. In a case where the element 50 to be driven is the μLED, a second electrode of the third transistor T3 is coupled to an anode of the μLED. In addition, the element 50 to be driven is further coupled to the second voltage terminal V2, that is, a cathode of the μLED is coupled to the second voltage terminal V2.

In this case, in order to transmit the drive current generated by the drive sub-circuit 30 to the μLED so as to drive the μLED to emit light, there need to be a voltage difference between a voltage of the first voltage terminal V1 and a voltage of the second voltage terminal V2, so that the drive current can be transmitted to the μLED through a current path closed between the first voltage terminal V1 and the second voltage terminal V2 and drive the μLED to emit light. Based on this, a circuit structure shown in FIG. 3 is described by taking an example in which a high level VDD (Voltage Drain-Drain) is input to the first voltage terminal V1 and a low level VSS (Voltage Source-Source) is input to the second voltage terminal V2. In this case, the second voltage terminal V2 may also be grounded, where high and low only indicate a relative magnitude relationship between input voltages.

Figure 4A:
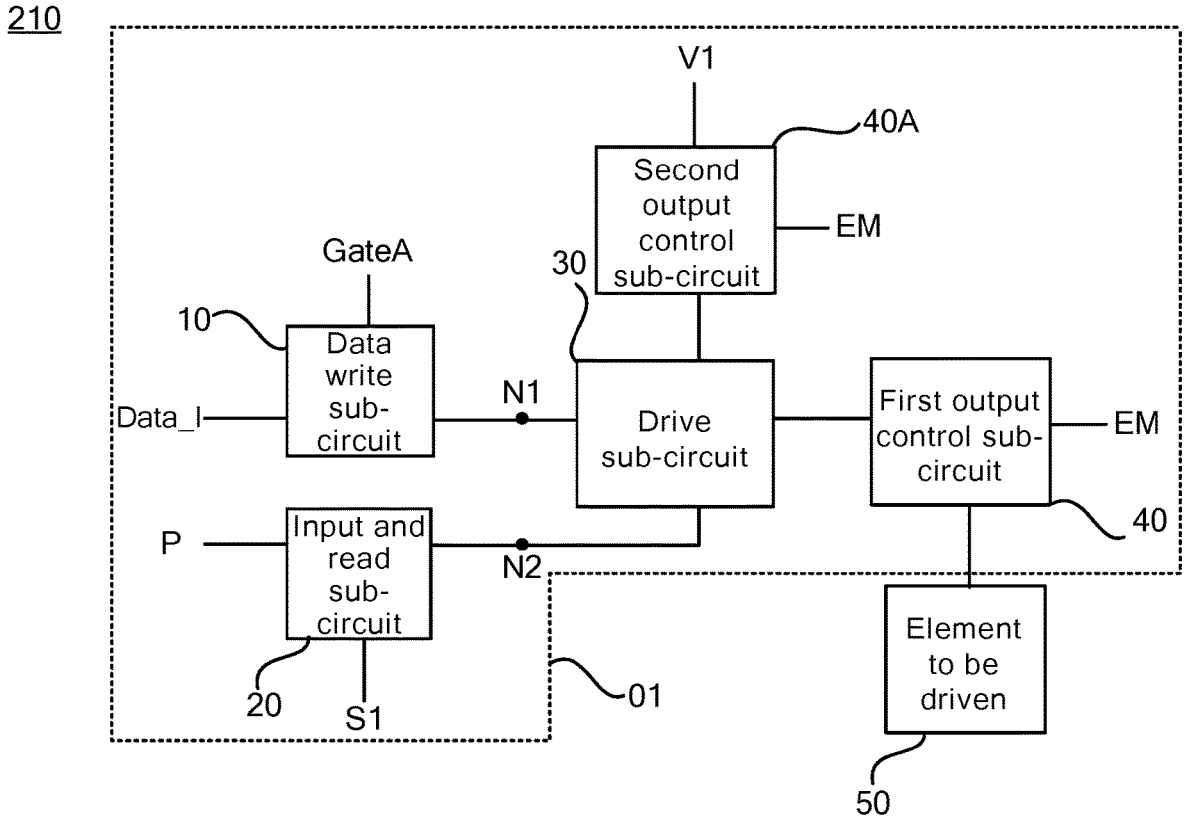
FIG. 4A is a circuit structural diagram of yet another pixel unit, in accordance with some embodiments.

In some embodiments, as shown in FIG. 4A, the pixel drive circuit 01 further includes a second output control sub-circuit 40A. The second output control sub-circuit 40A is coupled to the first voltage terminal V1, the drive sub-circuit 30, and the enable signal terminal EM.

Figure 4B:
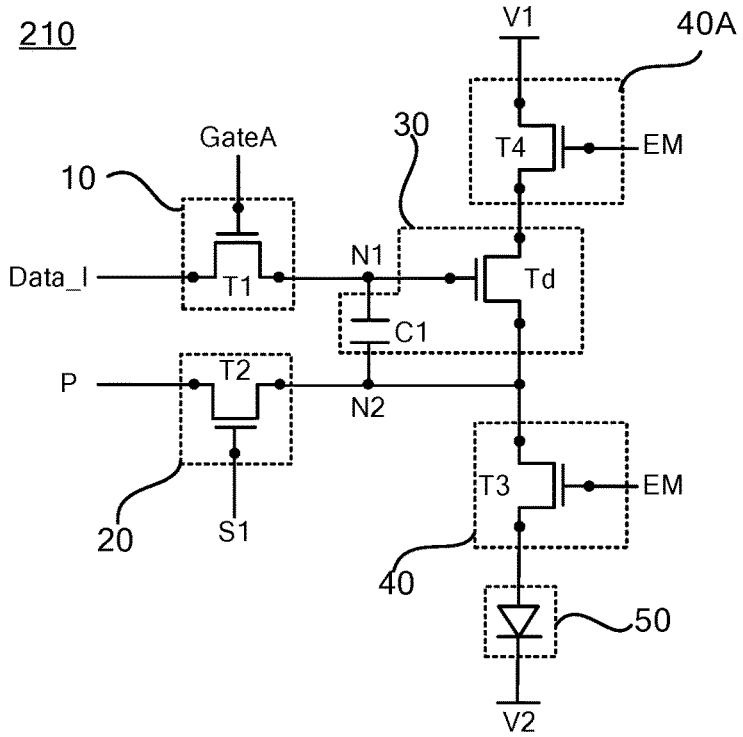
FIG. 4B is an equivalent circuit diagram of yet another pixel unit, in accordance with some embodiments.

For example, as shown in FIG. 4B, the second output control sub-circuit 40A may include a fourth transistor T4.

A gate of the fourth transistor T4 is coupled to the enable signal terminal EM, a first electrode of the fourth transistor T4 is coupled to the first voltage terminal V1, and a second electrode of the fourth transistor T4 is coupled to the drive sub-circuit 30. In this case, the drive sub-circuit 30 is coupled to the first voltage terminal V1 through the fourth transistor T4.

In a case where a structure of the drive sub-circuit 30 shown in FIG. 4B includes the drive transistor Td, a second electrode of the fourth transistor T4 is coupled to the first electrode of the drive transistor Td.

It can be noted that in a case where the pixel drive circuit 01 includes the first output control sub-circuit 40 and the second output control sub-circuit 40A, a coupling manner of the first output control sub-circuit 40 and the second output control sub-circuit 40A in the pixel drive circuit 01 may be the same as described above. That is, in this case, the first electrode of the drive transistor Td is coupled to the second output control sub-circuit 40A, and the second electrode of the drive transistor Td is coupled to the second node N2 and the first output control sub-circuit 40.

Figure 4C:
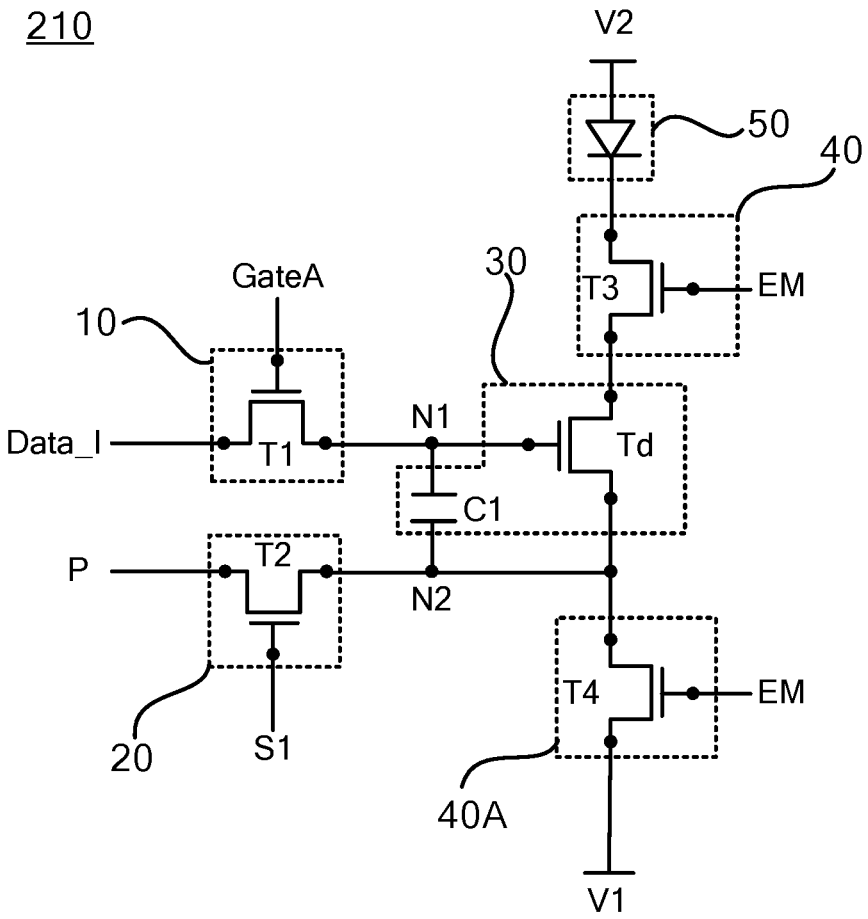
FIG. 4C is an equivalent circuit diagram of yet another pixel unit, in accordance with some embodiments.

Or, referring to FIG. 4C, in some other examples, the second output control sub-circuit 40A is coupled to the enable signal terminal EM, the first voltage terminal V1, the drive sub-circuit 30, and the second node N2. The first output control sub-circuit 40 is coupled to the enable signal terminal EM, the drive sub-circuit 30 and the element 50 to be driven, and the element 50 to be driven is further coupled to the second voltage terminal V2. That is, in this case, the first electrode of the drive transistor Td is coupled to the second node N2 and the second output control sub-circuit 40A, and the second electrode of the drive transistor Td is coupled to the first output control sub-circuit 40. It can be noted that a description is made by taking an example in which the high level VDD is input to the second voltage terminal V2, and the low level VSS is input to the first voltage terminal V1. The first voltage terminal V1 may also be grounded, and high and low herein only indicate a relative magnitude relationship between the input voltages.

For example, as shown in FIG. 4C, the first output control sub-circuit 40 includes the third transistor T3, the second output control sub-circuit 40A includes the fourth transistor T4.

A gate of the third transistor T3 is coupled to the enable signal terminal EM, a first electrode of the third transistor T3 is coupled to the drive sub-circuit 30, a second electrode of the third transistor T3 is coupled to the element 50 to be driven. In a case where the drive sub-circuit 30 includes the drive transistor Td, the first electrode of the third transistor T3 is coupled to the second electrode of the drive transistor Td.

The gate of the fourth transistor T4 is coupled to the enable signal terminal EM, the first electrode of the fourth transistor T4 is coupled to the first voltage terminal V1, and the second electrode of the fourth transistor T4 is coupled to the drive sub-circuit 30. In the case where the drive sub-circuit 30 includes the drive transistor Td, the second electrode of the fourth transistor T4 is coupled to the first electrode of the drive transistor Td.

It can be noted that the first output control sub-circuit 40 may further include a plurality of switching transistors connected in parallel with the third transistor T3, and the second output control sub-circuit 40A may further include a plurality of switching transistors connected in parallel with the fourth transistor T4. The above is merely an example of the first output control sub-circuit 40 and the second output control sub-circuit 40A, and other structures with a same function as the first output control sub-circuit 40 and the second output control sub-circuit 40A will not be repeated herein, but shall all be included in the protection scope of the present disclosure.

As shown in FIGS. 4B and 4C, the pixel drive circuit provided by of the some embodiments includes 5 transistors and 1 storage capacitor C1 which has a simple structure, low cost and a large aperture ratio, and may be applied to products with high pixels per inch (PPI).

Based on the above description of each sub-circuit, a specific driving process of the pixel unit provided in some embodiments of the present disclosure will be described in detail below using different examples.

It can be noted that embodiments of the present disclosure do not limit types of transistors in each sub-circuit. That is, the first transistor T1, the second transistor T2, the third transistor T3, the fourth transistor T4, and the drive transistor Td described above may be N-type transistors. In this case, first electrodes of the above transistors may be drains, and second electrodes of the above transistors may be sources. Or, the above transistors are all P-type transistors. In this case, the first electrodes of the above transistors may be the sources and the second electrodes of the above transistors may be the drains. The embodiments of the present disclosure are described by taking an example in which the above transistors are all the N-type transistors.

Figure 5:
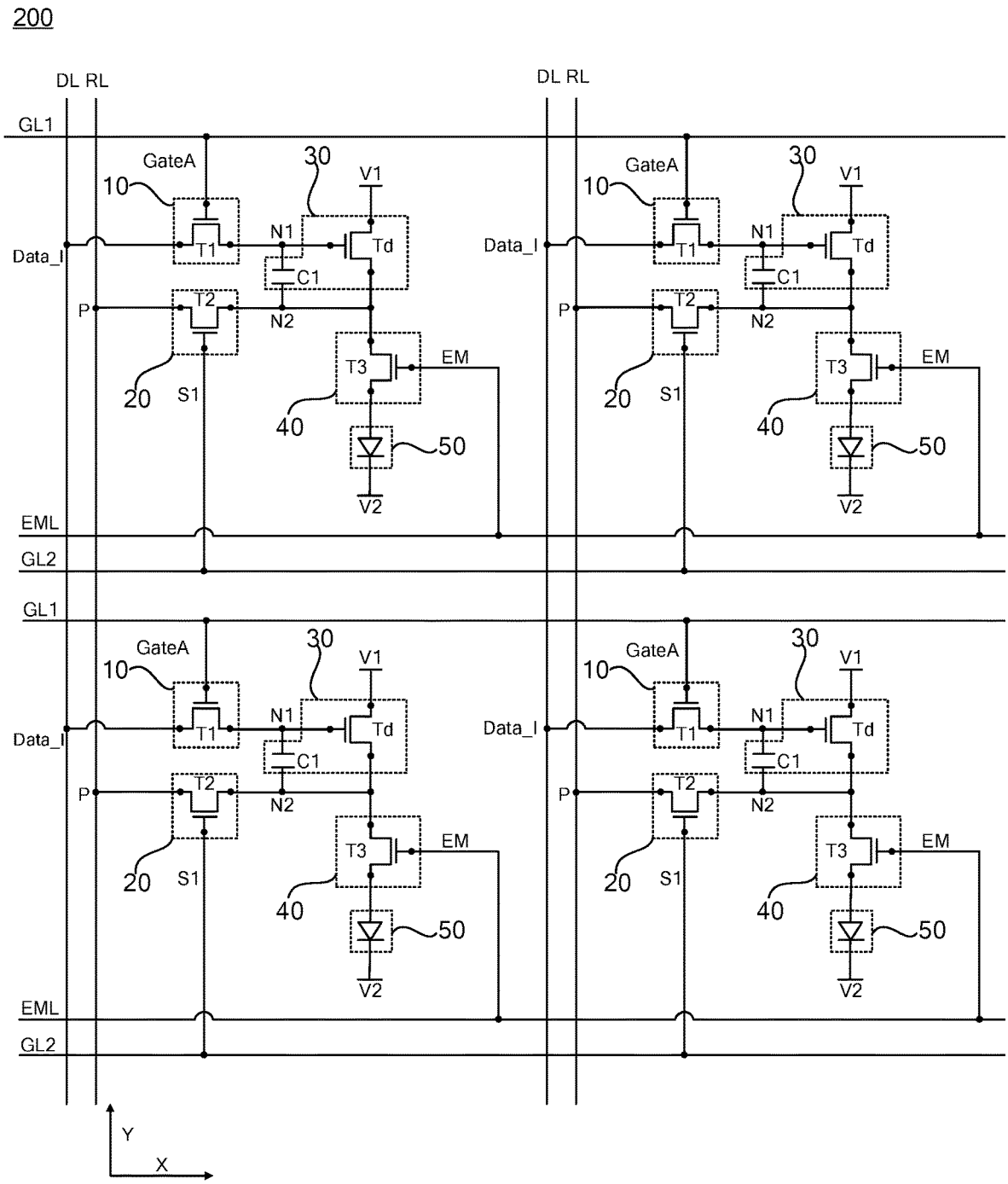
FIG. 5 is a circuit structural diagram of an array substrate, in accordance with some embodiments.

The above is an example of a specific structure of the pixel drive circuit in a pixel unit. As shown in FIG. 1B, the plurality of pixel units 210 (i.e., sub-pixels) arranged in an array are provided in the array substrate 200. In this case, FIG. 5 shows an example in which sub-pixels arranged in a 2×2 array in the array substrate, it can be seen that in a case where the array substrate includes the plurality of read signal lines RL, one read signal line RL is coupled to input and read sub-circuits 20 in pixel drive circuits of a same column in the Y direction. In a case where the input and read sub-circuit 20 includes the second transistor T2, the read signal line RL is coupled to the first electrode of the transistor.

In a case where the array substrate includes the plurality of data lines DL, one data line DL is coupled to data write sub-circuits 10 in the pixel drive circuits of the same column in the Y direction. In a case where the data write sub-circuit includes the first transistor T1, the data line DL is coupled to the first electrode of the transistor.

In addition, as shown in FIG. 5, the array substrate further includes a plurality of signal lines, such as first scan signal lines GL1, enable signal lines EML, and second scan signal lines GL2. One first scan signal line GL1 is coupled to data write sub-circuits 10 in pixel drive circuits of a same row in the X direction. In the case where the data write sub-circuit 10 includes the first transistor T1, the first scan signal line GL1 is coupled to the gate of the first transistor T1.

One enable signal line EML is coupled to first output control sub-circuits 40 in the pixel drive circuits in the same row. In a case where the first output control sub-circuit 40 includes the third transistor T3, the enable signal line EML is coupled to the gate of the third transistor T3. On this basis, one enable signal line EML may further be coupled to second output control sub-circuits 40A in the pixel drive circuits of the same row. In a case where the second output control sub-circuit 40A includes the fourth transistor T4, the enable signal line EML is coupled to the gate of the fourth transistor T4.

One second scan signal line GL2 is coupled to input and read sub-circuits 20 in the pixel drive circuits in the same row. In a case where the input and read sub-circuit 20 includes the second transistor T2, the second scan signal line GL2 is coupled to the gate of the second transistor T2.

In addition, the transistors in the pixel drive circuit described above may be divided into enhancement-mode transistors and depletion-mode transistors according to different conductive methods of transistors, which is not limited in the embodiments of the present disclosure.

Some embodiments of the present disclosure may compensate a threshold voltage Vth of the drive transistor Td in the drive sub-circuit 30, so as to improve a light-emitting uniformity of the light-emitting device.

Figure 6:
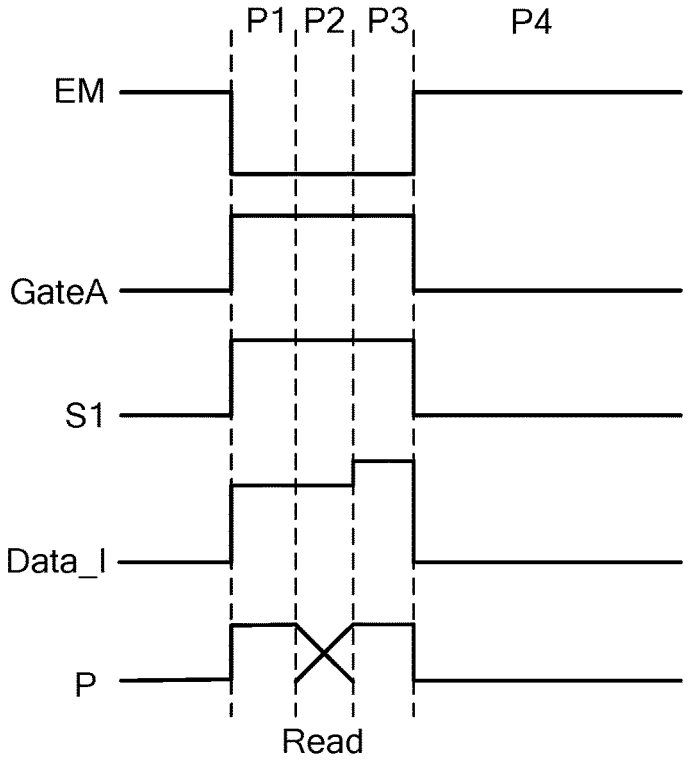
FIG. 6 is a timing diagram of driving a circuit of the pixel unit shown in FIG. 4B, in accordance with some embodiments.

As shown in FIG. 6, a driving process of the pixel drive circuit is divided into an initialization period P1, a threshold voltage read period P2, a threshold voltage compensation period P3 and a light-emitting period P4.

In the initialization period P1, a high level turn-on signal is input to the first scan signal terminal GateA and the first signal terminal S1, and a low level turn-off signal is input to the enable signal terminal EM.

For example, the data write sub-circuit 10 in FIG. 4B transmits a first initialization data signal input from the first data voltage terminal Data_I to the first node N1 under control of a turn-on signal transmitted from the first scan signal terminal GateA, so as to initialize the first node N1 through the first initialization data signal to prevent electrical signals remaining on the first node N1 in a previous frame from affecting a current frame.

Figure 7:
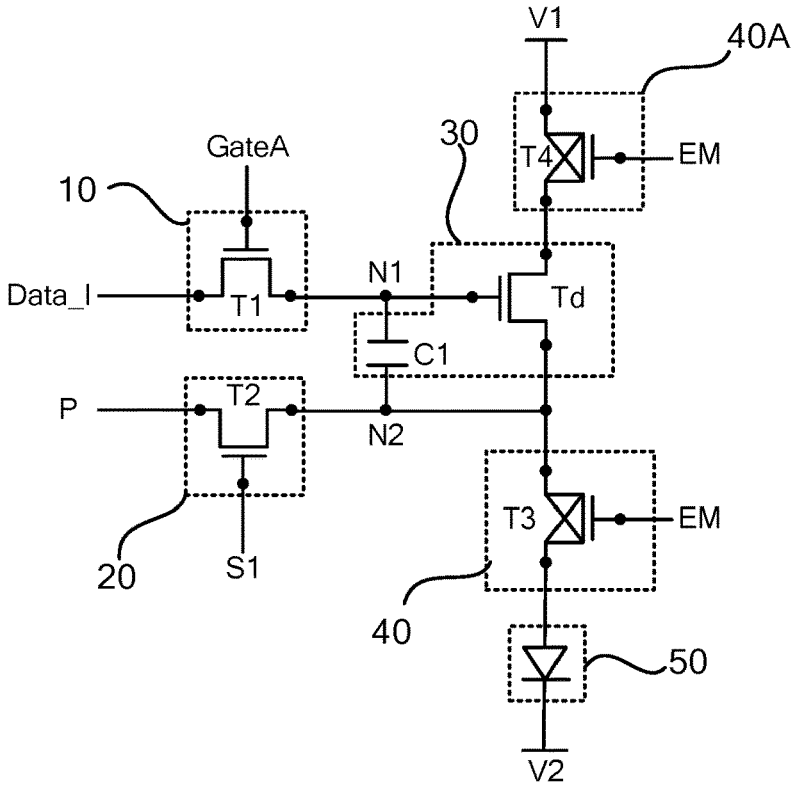
FIG. 7 is a driving state diagram of the pixel unit circuit shown in FIG. 4B.

FIG. 7 is an equivalent circuit diagram of the pixel drive circuit in FIG. 4B in the initialization period P1. As shown in FIG. 7, the data write sub-circuit 10 includes the first transistor T1. The high level turn-on signal is input to the first scan signal terminal GateA to control the first transistor T1 to turn on, and the first initialization data signal input from the first data voltage terminal Data_I (e.g., the first initialization data signal is the same as the first data signal Vdata1) is transmitted to the first node N1 through the first transistor T1 to initialize a potential of the first node N1. The input and read sub-circuit 20 transmits a second initialization data signal input from the signal transmission terminal P to the second node N2 under the control of the turn-on signal transmitted by the first signal terminal S1, so as to initialize the second node N2 through the second initialization data signal.

As shown in FIG. 7, the input and read sub-circuit 20 includes the second transistor T2. A high level turn-on signal is input to the first signal terminal S1 to control the second transistor T2 to turn on, and the second initialization data signal V_ref input from the signal transmission terminal P is transmitted to the second node N2 through the second transistor T2.

In addition, the first output control sub-circuit 40 and the second output control sub-circuit 40A are not in an operating state in this period. As shown in FIG. 7, the first output control sub-circuit 40 includes the third transistor T3, and the second output control sub-circuit 40A includes the fourth transistor T4. In this case, in the initialization period P1 as shown in FIG. 6, a low level turn-off signal is input to the enable signal terminal EM, as a result, the third transistor T3 and the fourth transistor T4 are turned off. The transistors in an off state are indicated by a symbol "×" in FIG. 7.

At the end of the initialization period P1, a potential of the first node N1 is Vdata1, and a potential of the second node N2 is V_ref.

In the threshold voltage read period P2, as shown in FIG. 7, similar to the initialization period P1, the high level turn-on signal is input to the first scan signal terminal GateA, as a result, the first transistor T1 is still in a turn-on state, and the first data signal Vdata1 input from the first data voltage terminal Data_I is transmitted to the first node N1 through the first transistor T1. The first data signal Vdata1 is related to a gray scale of an image displayed by the pixel unit 210.

In addition, in a case where the drive sub-circuit 30 includes the first storage capacitor C1 and the drive transistor Td, since the two terminals of the first storage capacitor C1 are coupled to the first node N1 (the potential thereof is Vdata 1) and the second node N2 (the potential thereof is V_ref), respectively, the drive transistor Td is turned on. When no signal input from an external power source is transmitted to the second node N2, the potential of the second node N2 will change according to a gate voltage of the drive transistor Td (the potential of the first node N1). When a voltage difference between the potential of the first node N1 and the potential of the second node N2 is reduced to Vth, the drive transistor Td is turned off. Vth is the threshold voltage of the drive transistor Td.

Next, the input and read sub-circuit 20 transmits an electrical signal of the second node N2 to the signal transmission terminal P under the control of the turn-on signal transmitted by the first signal terminal S1. Similar to the initialization period P1, the high level turn-on signal is input to the first signal terminal S1, as a result, the second transistor T2 is still in a turn-on state, and the electrical signal of the second node N2 is transmitted to the signal transmission terminal P.

At the end of the threshold voltage read period P2, the potential of the first node N1 is Vdata1, and the potential of the second node N2 is equal to Vdata1 minus Vth (Vdata1−Vth). In this case, the integrated circuit 100 may be coupled to the signal transmission terminal P through the read signal line RL, so as to be able to receive the electrical signal of the second node N2 and compare the electrical signal of the second node N2 with the electrical signal of the first node N1 to obtain the threshold voltage Vth of the drive transistor Td. In this way, the threshold voltage Vth may be added to the second data signal Vdata2 in the threshold voltage compensation period P3, so as to output the second data signal Vdata2 through the first data voltage terminal Data_I.

In threshold voltage compensation period P3, the data write sub-circuit 10 transmits the second data signal Vdata2 input from the first data voltage terminal Data_I to the first node N1 under the control of the turn-on signal transmitted from the first scan signal terminal GateA, and stores the second data signal Vdata2 to the drive sub-circuit 30. The second data signal Vdata2 is a signal obtained by compensating the first data signal Vdata1.

As shown in FIG. 7, in a case where the data write sub-circuit 10 includes the first transistor T1, the high level turn-on signal is input to the first scan signal terminal GateA to control the first transistor T1 to turn on, and the second data signal Vdata2 input from the second data voltage terminal Data_I is transmitted to the first node N1 through the first transistor T1. In a case where the drive sub-circuit 30 includes the first storage capacitor C1, the second data signal Vdata2 is stored in the first storage capacitor C1. The second data signal Vdata2 is a signal obtained by compensating the first data signal Vdata1, for example, it may be equal to a sum of Vdata1 and Vth (Vdata2=Vdata1+Vth).

The signal transmission terminal P may receive a signal same as the signal from the second voltage terminal V2, and the input and read sub-circuit 20 transmits a potential signal input from the signal transmission terminal P to the second node N2 under the control of the turn-on signal transmitted by the first signal terminal S1.

As shown in FIG. 7, in a case where the input and read sub-circuit 20 includes the second transistor T2, the high level turn-on signal is input to the first signal terminal S1 to control the second transistor T2 to turn on, the potential signal of the second voltage terminal V2 received by the signal transmission terminal P is transmitted to the second node N2 through the second transistor T2.

In some embodiments, the potential of the signal transmission terminal P may be equal to a low level VSS of the second voltage terminal V2, so as to prevent a change in Vgs caused by a potential change of the first node N1 due to the potential of the second node N2 changing to VSS in the light-emitting period P4 from affecting a luminous current.

In the light-emitting period P4,

A low level turned-off signal is input to the first scan signal terminal GateA and the first signal terminal S1, and the first transistor T1 and the second transistor T2 are both in a turn-off state. The first output control sub-circuit 40 and the second output control sub-circuit 40A cause a signal path to be closed between the first voltage terminal V1 and the second voltage terminal V2 under the control of the turn-on signal transmitted by the enable signal terminal EM, and the signal of the first voltage terminal V1 is transmitted to the drive sub-circuit 30. The drive sub-circuit 30 outputs a drive signal under the control of the signal of the first node N1, the signal of the second node N2, and the signal of the first voltage terminal V1.

Figure 8:
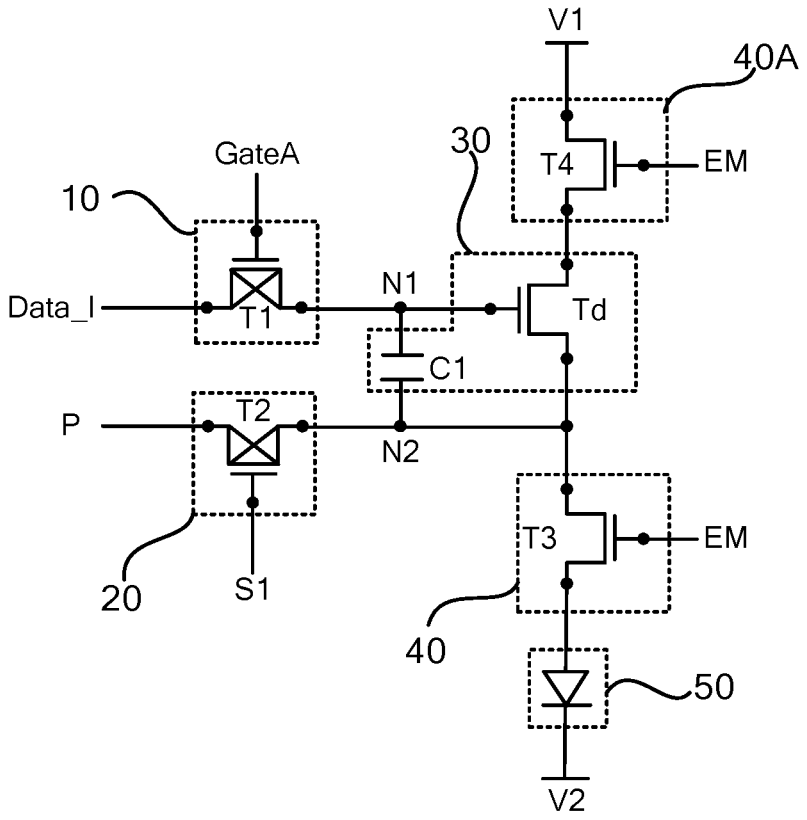
FIG. 8 is another driving state diagram of the pixel unit circuit shown in FIG. 4B.

FIG. 8 is an equivalent circuit diagram of the pixel drive circuit shown in FIG. 4B in the light-emitting period P4. As shown in FIG. 8, the first output control sub-circuit 40 includes the third transistor T3, and the second output control sub-circuit 40A includes the fourth transistor T4. A high level turn-on signal is input to the enable signal terminal EM to control the third transistor T3 and the fourth transistor T4 to turn on. The drive sub-circuit 30 includes the first storage capacitor C1 and the drive transistor Td. The drive transistor Td remains turned on under action of the first storage capacitor C1. The signal path is closed between the first voltage terminal V1 and the second voltage terminal V2. The drive transistor Td outputs a drive signal under the control of the signal of the first node N1, the signal of the second node N2 and the signal of the first voltage terminal V1.

The element 50 to be driven receives the drive signal transmitted in the signal path, and emits light under driving of the drive signal.

In the light-emitting period P4, the voltage of the first node N1 is Vdata2, and the voltage of the second node N2 is VSS. Vgs of the drive transistor Td satisfies the following equation: Vgs=Vg−Vs=Vdata2−VSS=Vdata1+Vth−VSS, where Vg is a voltage of the gate, and Vs is a voltage of a source of the drive transistor Td.

After the drive transistor Td is turned on, when a difference value between a gate-source voltage Vgs of the drive transistor Td and the threshold voltage Vth of the drive transistor Td is less than or equal to a drain-source voltage Vds of the drive transistor Td, that is, when Vgs−Vth≤Vds, the drive transistor Td can be in a saturation and turn-on state. In this case, a drive current $I_{LED}$ flowing through the drive transistor Td satisfies the following equations:

$$I_{LED} = \frac{1}{2}\mu C_{OX}\frac{W}{L}(Vgs - Vth)^2 = \frac{1}{2}\mu C_{OX}\frac{W}{L}(Vdata1 + Vth - VSS - Vth)^2 = \frac{1}{2}\mu C_{OX}\frac{W}{L}(Vdata1 - VSS)^2$$

W/L is a width-to-length ratio of the drive transistor Td, $C_{OX}$ is a dielectric constant of a channel insulating layer, and μ is a channel carrier mobility.

The above parameters are only related to a structure of the drive transistor Td, the first data signal Vdata1 output from the first data voltage terminal Data_I and VSS output from the second voltage V2, and are unrelated to the threshold voltage Vth of the drive transistor Td, thereby eliminating an influence of the threshold voltage Vth of the drive transistor Td on luminance of a self-luminous device, and improving a luminance uniformity of the self-luminous device.

Figure 9:
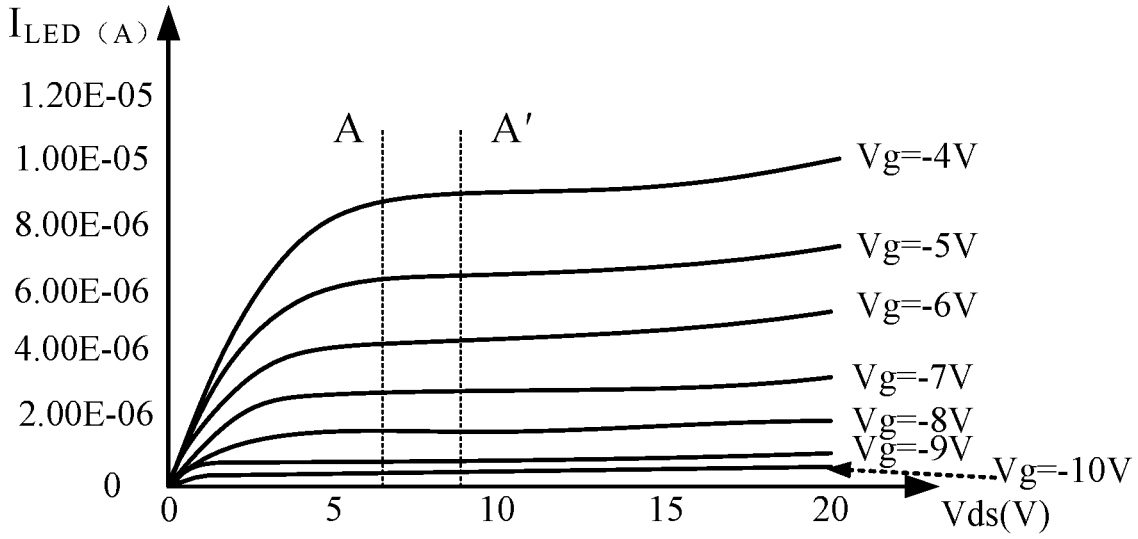
FIG. 9 is a performance diagram of a drive transistor, in accordance with some embodiments of the present disclosure.

FIG. 9 shows an output characteristic curve of the drive transistor Td, the X-axis represents Vds voltage, and the Y-axis represents $I_{LED}$. It can be seen from FIG. 9 that there exists a region (e.g., within a range of A-A'), where currents generated by different Vgs voltages in this region are all in a steady state. Based on this, the drive transistor Td may operate in an A-A' region by a reasonable design and selecting a driving mode of the current-driven LED, so as to generate a stable drive current, thereby ensuring stability of the luminance.

Figure 10:
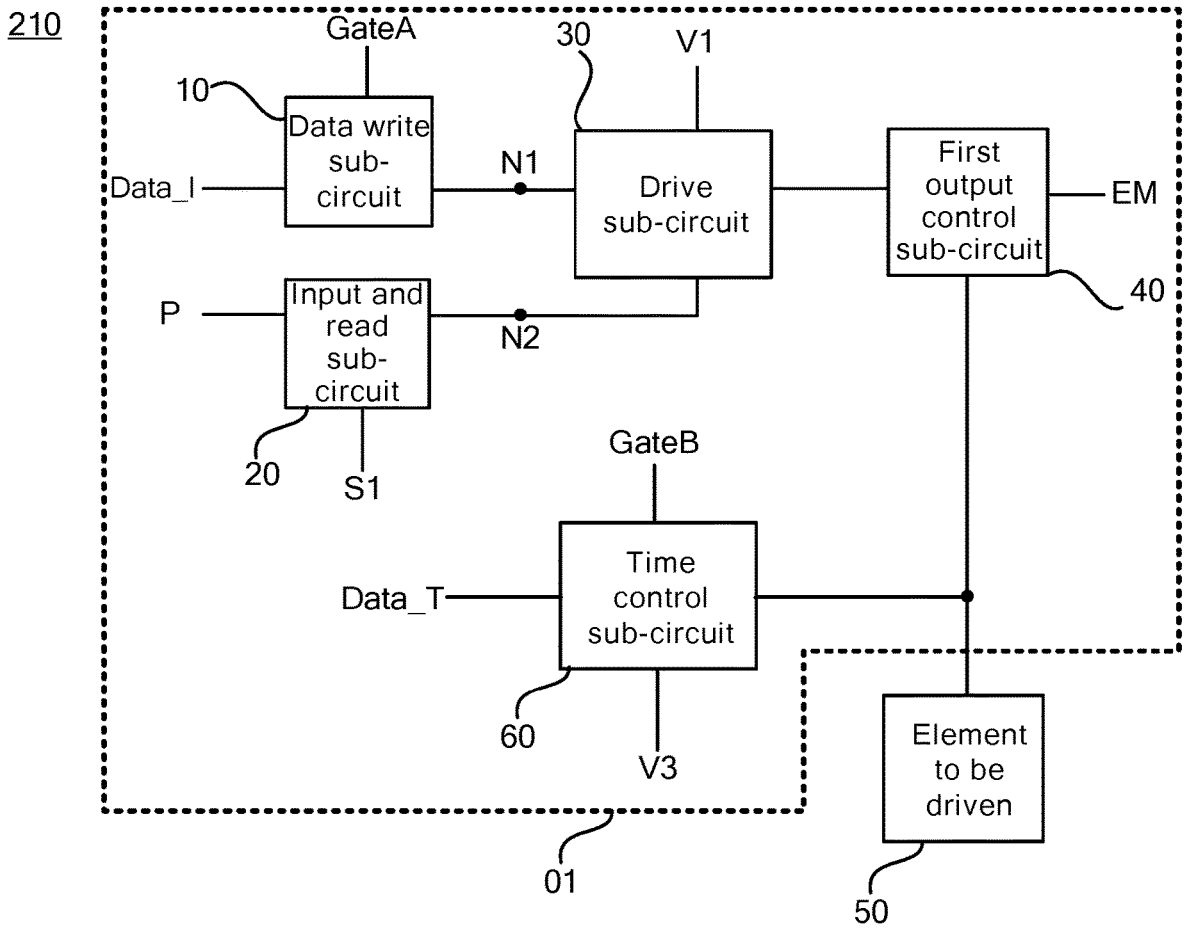
FIG. 10 is a circuit structural diagram of yet another pixel unit, in accordance with some embodiments.

In some embodiments of the present disclosure, as shown in FIG. 10, the pixel drive circuit 01 further includes a time control sub-circuit 60. The time control sub-circuit 60 may control an on-off duration of the signal path closed between the first voltage terminal V1 and the second voltage terminal V2, thereby adjusting a luminance of the element 50 to be driven in combination with an on-off condition of the third transistor T3 in the first output control sub-circuit 40.

The time control sub-circuit 60 is coupled to a second scan signal terminal GateB, a third voltage terminal V3, a second data voltage terminal Data_T, the first output control sub-circuit 40 and the element 50 to be driven. The time control sub-circuit 60 is configured to: store a signal of the second data voltage terminal Data_T under control of the turn-on signal transmitted by the second scan signal terminal GateB, and control operating time of the first output control sub-circuit 40 and the element 50 to be driven according to the signal of the second data voltage terminal Data_T.

Figure 11:
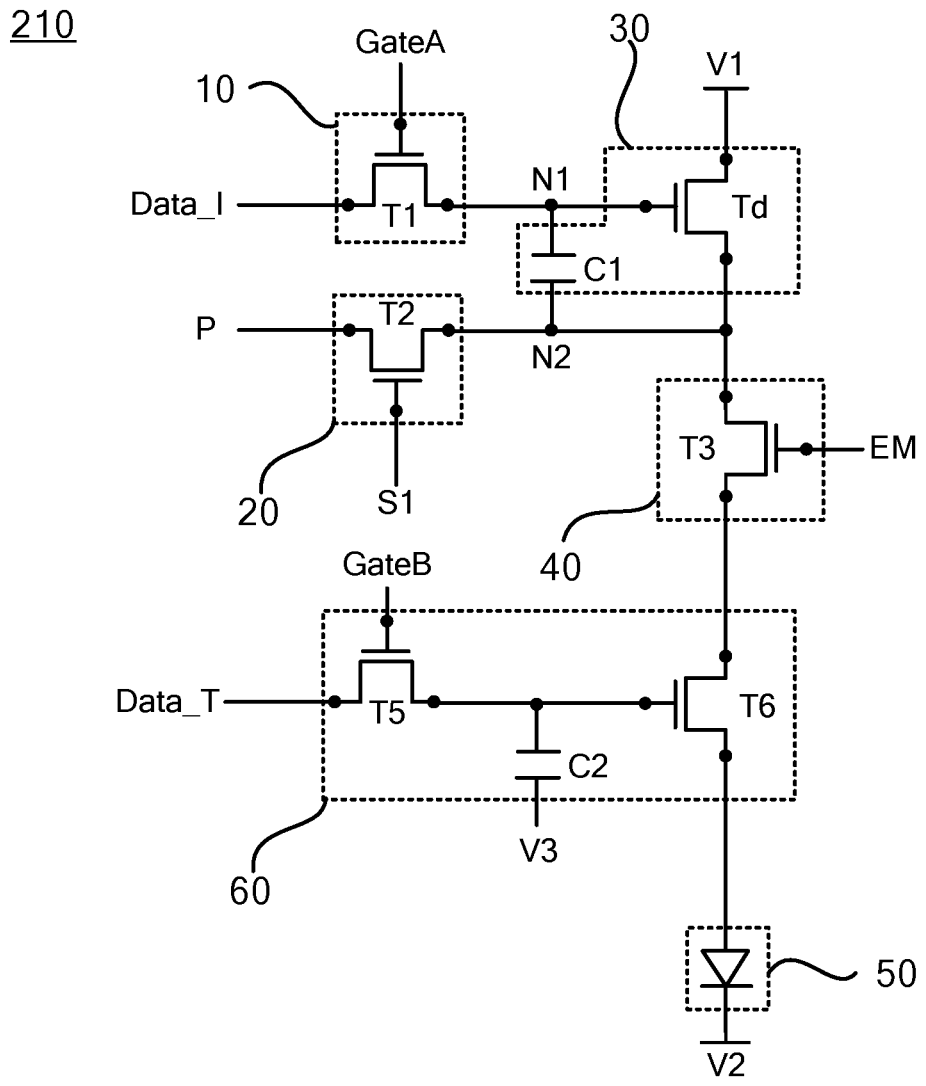
FIG. 11 is an equivalent circuit diagram of yet another pixel unit, in accordance with some embodiments.

In some embodiments of the present disclosure, as shown in FIG. 11, the time control sub-circuit 60 includes a fifth transistor T5, a sixth transistor T6 and a second storage capacitor C2.

A gate of the fifth transistor T5 is coupled to the second scan signal terminal GateB, a first electrode of the fifth transistor T5 is coupled to the second data voltage terminal Data_T, and a second electrode of the fifth transistor T5 is coupled to a first terminal of the second storage capacitor C2 and a gate of the sixth transistor T6.

A first electrode of the sixth transistor T6 is coupled to the first output control sub-circuit 40, and a second electrode of the sixth transistor T6 is coupled to the element 50 to be driven.

A second terminal of the second storage capacitor C2 is coupled to the third voltage terminal V3. For example, the third voltage terminal V3 may be a common voltage terminal (Vcom).

It can be noted that the time control sub-circuit 60 may further include a plurality of switching transistors connected in parallel with the fifth transistor T5, and/or a plurality of switching transistors connected in parallel with the sixth transistor T6. The above is merely an example of the control sub-circuit 60, and other structures with a same function as the control sub-circuit 60 will not be repeated herein, but shall all be included in the protection scope of the present disclosure.

The fifth transistor T5 and the sixth transistor T6 may be all N-type transistors. In this case, first electrodes of the above transistors may be the drains, and second electrodes of the above transistors may be the sources. Or, all the above transistors are P-type transistors. In this case, the first electrodes of the above transistors may be the sources and the second electrodes of the above transistors may be the drains. Embodiments of the present disclosure are described by taking an example in which the above transistors are all the N-type transistors.

The above is a description of a structure of the time control sub-circuit 60 in one pixel drive circuit 01. In a case where the array substrate includes the plurality of sub-pixels arranged in an array, second data voltage terminals Data_T in pixel drive circuits 01 of pixel units in a same column (in the Y direction in FIG. 5) may be coupled through one signal line. Since the second data voltage terminal Data_T is coupled to the first electrode of the fifth transistor T5 in the time control sub-circuit 60, the above signal line is coupled to the first electrode of the fifth transistor. In addition, second scan signal terminals GateB in pixel drive circuits 01 of pixel units in a same row (in the X direction in FIG. 5) may be coupled through one scan signal line. Since the second scan signal terminal GateB is coupled to the gate of the fifth transistor T5 in the time control sub-circuit 60, the scan signal line may be coupled to the gate of the fifth transistor T5.

In this way, when the display panel displays an image, each scan signal line coupled to gates of fifth transistors T5 in pixel drive circuits 01 in the same row may be scanned row by row to turn on fifth transistors T5 row by row. After fifth transistors T5 in one row are turned on, a light-emitting time of elements 50 to be driven may be controlled through a signal provided by the signal line coupled to first electrodes of the fifth transistors T5 (i.e., the signal of the second data voltage terminal Data_T).

It can be seen from the above that when the drive transistor Td in the drive sub-circuit 30 is turned on, the first output control sub-circuit 40 may couple the first voltage terminal V1 to the element 50 to be driven (i.e., light-emitting device) under the control of the turn-on signal transmitted by the enable signal terminal EM, and the light-emitting device is further coupled to the second voltage terminal V2. In this case, in a case where the time control sub-circuit 60 is disposed between the first output control sub-circuit 40 and the element 50 to be driven, and when the time control sub-circuit 60 is in an operating state, the signal path is closed between the first voltage terminal V1 and the second voltage terminal V2; when the time control sub-circuit 60 is in a non-operating state, the signal path fails to be closed between the first voltage terminal V1 and the second voltage terminal V2. Therefore, the on-off duration of the signal path closed between the first voltage terminal V1 and the second voltage terminal V2 may be controlled by the time control sub-circuit 60.

In addition, it can be seen from the above that the on-off duration of the signal path closed between the first voltage terminal V1 and the second voltage terminal V2 is also related to whether the third transistor T3 in the first output control sub-circuit 40 controlled by the enable signal terminal EM is turned on or turned off. Therefore, an on-off state of the time control sub-circuit 60 may be superimposed with an on-off state of the third transistor T3 in the first output control sub-circuit 40, and a diversification of a superimposition method may make effective luminance of the light-emitting device diversified. Thereby, a drive current with relatively constant current magnitude in a certain range may be used to drive the light-emitting device to emit light, so as to prevent photoelectric characteristics of the light-emitting device from drifting with a change of a current density, which may realize high brightness and high contrast.

A specific driving process of the pixel drive circuit will be described in detail below.

Figure 12:
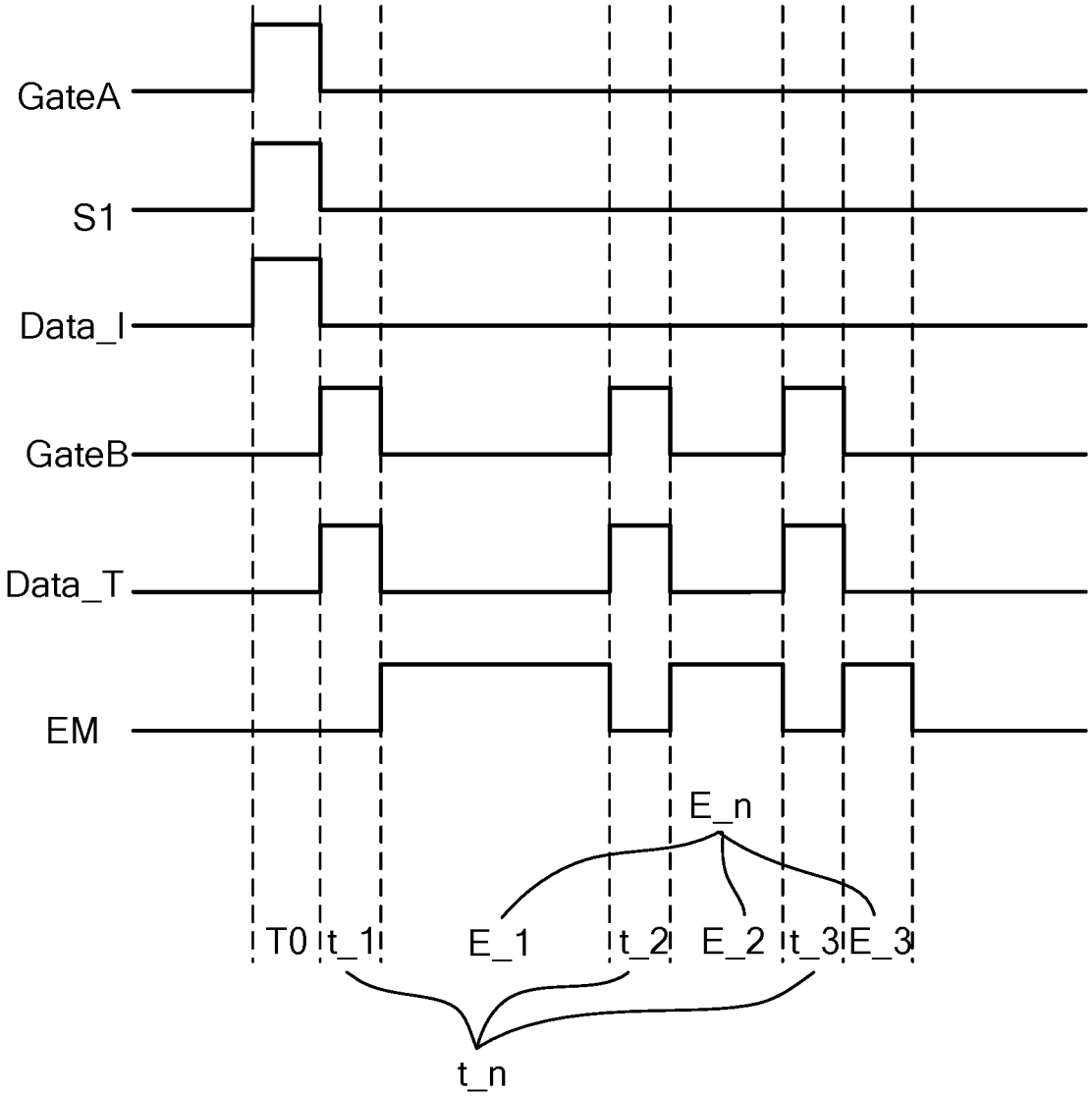
FIG. 12 is a timing diagram of driving a circuit of the pixel unit shown in FIG. 11.

FIG. 12 is a timing control diagram of the pixel drive circuit provided by some embodiments of the present disclosure in a display period. The driving process of the pixel drive circuit shown in FIG. 11 in the display period will be described in detail below with reference to FIG. 12. The driving process of the pixel drive circuit in the display period includes: a write period T0, a time control period t_n and a light-emitting period E_n.

In the write period T0, the data write sub-circuit 10 transmits a data signal input from the first data voltage Data_I to the first node N1 under control of a turn-on signal transmitted by the first scan signal terminal GateA.

Figure 13:
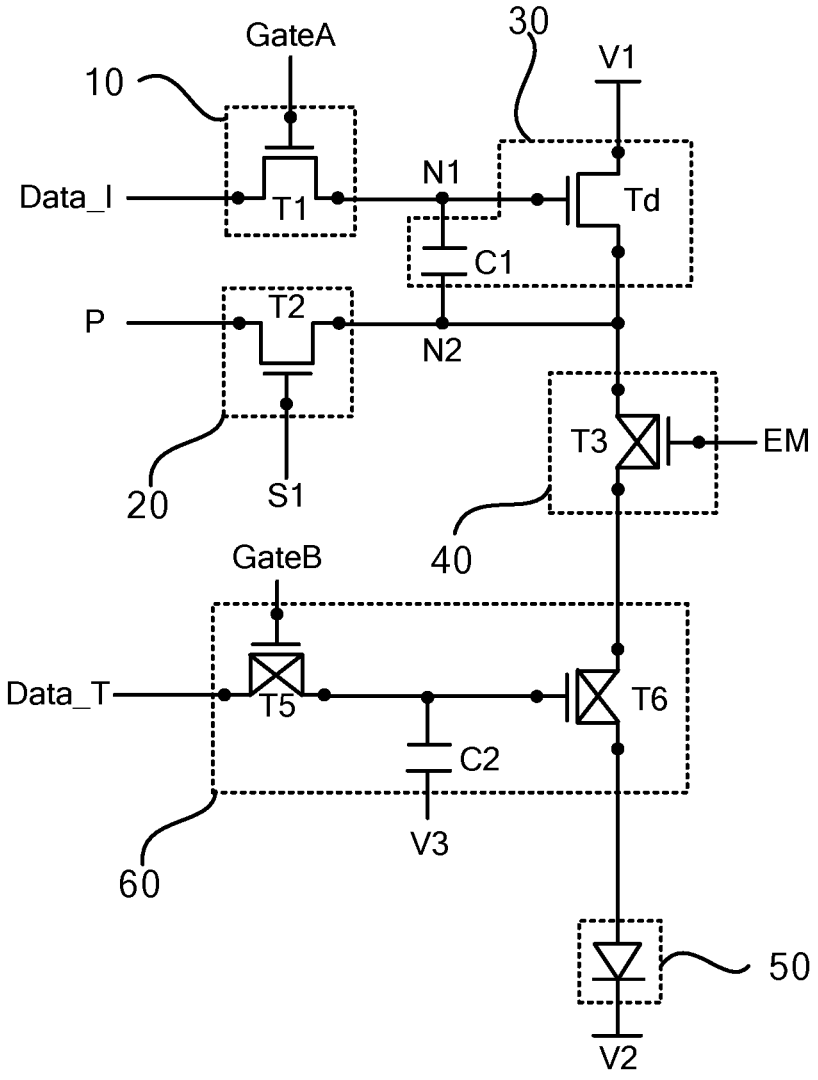
FIG. 13 is a driving state diagram of the circuit of the pixel unit shown in FIG. 11.

FIG. 13 is an equivalent circuit diagram of the pixel drive circuit shown in FIG. 11 in the write period T0. As shown in FIG. 13, the data write sub-circuit 10 includes the first transistor T1. A high level turn-on signal is input to the first scan signal terminal GateA to control the first transistor T1 to turn on. A data signal input from the first data voltage terminal Data_I is transmitted to the first node N1 through the first transistor T1.

The input and read sub-circuit 20 transmits a signal of the signal transmission terminal P to the second node N2 under control of a turn-on signal transmitted by the first signal terminal S1 to initialize the second node N2.

As shown in FIG. 13, the input and read sub-circuit 20 includes the second transistor T2. A high level turn-on signal is input to the first signal terminal S1 to control the second transistor T2 to turn on, and an initialization signal input from the signal transmission terminal P is transmitted to the second node N2 to initialize the second node N2.

In the time control period t_n, the time control sub-circuit 60 stores a signal of the second data voltage terminal Data_T under control of a turn-on signal transmitted from the second scan signal terminal GateB.

Figure 14:
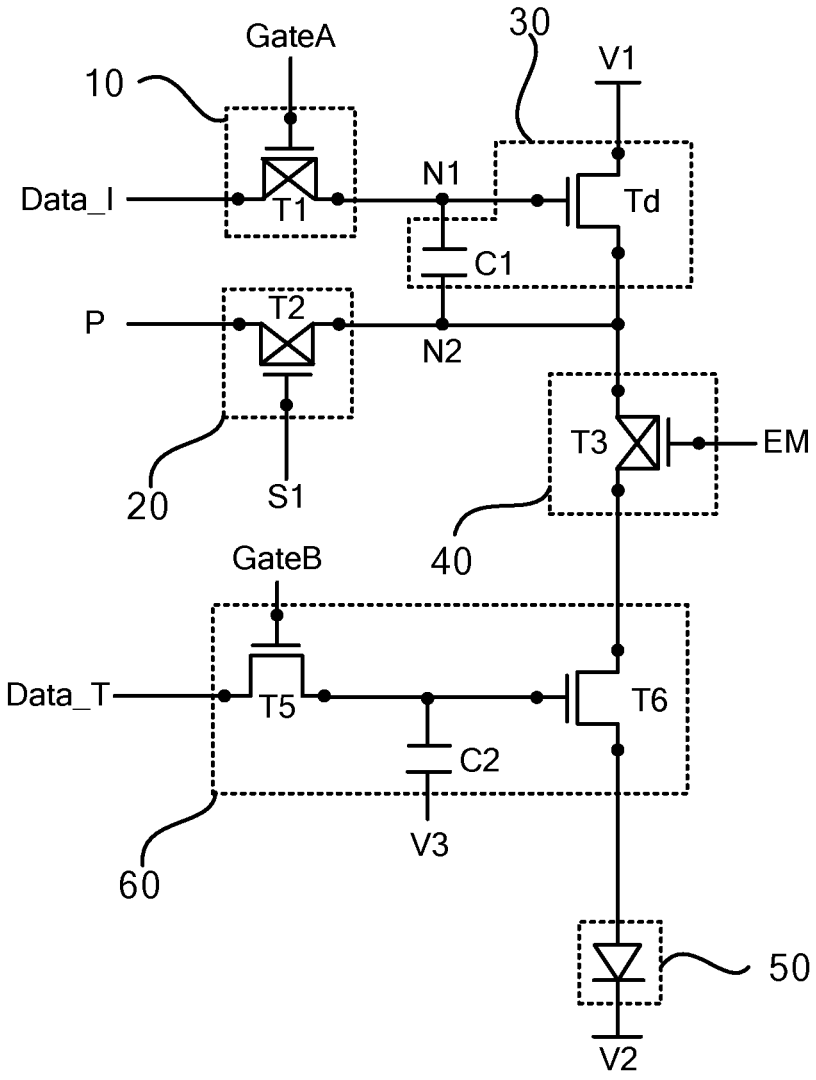
FIG. 14 is another driving state diagram of the circuit of the pixel unit shown in FIG. 11.

FIG. 14 is an equivalent circuit diagram of the pixel drive circuit shown in FIG. 11 in the time control period t_n. As shown in FIG. 14, the time control sub-circuit 60 includes the fifth transistor T5, the sixth transistor T6, and the second storage capacitor C2. A high level turn-on signal is input to the second scan signal terminal GateB to control the fifth transistor T5 to turn on. The signal input from the second data voltage terminal Data_T is transmitted to the second storage capacitor C2 through the fifth transistor T5 and is stored in the second storage capacitor C2.

For example, as shown in FIG. 12, the time control period t_n includes t_1, t_2, and t_3 sub-periods.

In the light-emitting period E_n, the first output control sub-circuit 40 transmits a signal of the first voltage terminal V1 to the drive sub-circuit 30 under control of a turn-on signal transmitted by the enable signal terminal EM, and the drive sub-circuit 30 outputs a drive signal under control of a signal of the first node N1, a signal of the second node N2, and a signal of the first voltage terminal V1.

Figure 15:
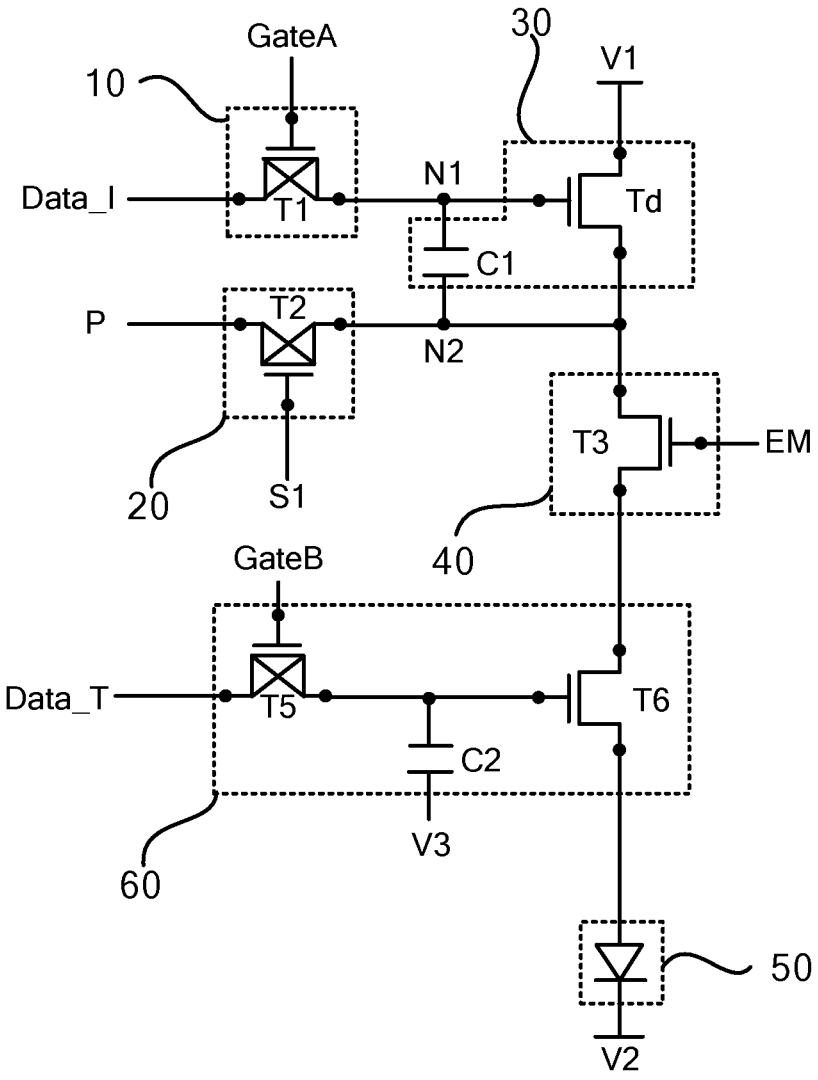
FIG. 15 is yet another driving state diagram of the circuit of the pixel unit shown in FIG. 11.

FIG. 15 is an equivalent circuit diagram of the pixel drive circuit shown in FIG. 11 in the light-emitting period E_n. As shown in FIG. 15, the first output control sub-circuit 40 includes the third transistor T3. When a high level is input to the enable signal terminal EM, the third transistor T3 is turned on, and a current path is closed between the first voltage terminal V1 and the second voltage terminal V2.

The time control sub-circuit 60 controls an operating time of the first output control sub-circuit 40 and the element 50 to be driven according to the signal from the second data voltage terminal Data_T, so as to control time during which the signal path is closed between the first voltage terminal V1 and the second voltage terminal V2.

The time control sub-circuit 60 includes the fifth transistor T5, the sixth transistor T6 and the second storage capacitor C2. Whether the sixth transistor T6 is turned on and the turn-on duration may be controlled according to the data signal stored in the second storage capacitor in the time control period Data_T, thereby controlling the operating time of the first output control sub-circuit 40 and the element 50 to be driven to control the time during which the signal path is closed between the voltage terminal V1 and the second voltage terminal V2.

When the signal path is closed between the first voltage terminal V1 and the second voltage terminal V2, the element 50 to be driven receives the drive signal transmitted in the signal path, and emits light under driving of the drive signal.

It can be noted that in a case where the pixel drive circuit 01 further includes the second output control sub-circuit 40A (referring to FIG. 4B), and the second output control sub-circuit 40A includes the fourth transistor T4, the time control sub-circuit 60 may also adjust the luminance of the element 50 to be driven in combination with an on-off condition of the fourth transistor T4 in the second output control sub-circuit 40A.

Whether the element 50 to be driven emits light in the light-emitting period E_n is determined by the signal input from the second data voltage terminal Data_T in the t_n period, and the light-emitting duration is determined by an active pulse width input from the enable signal terminal EM in this period. For example, when a high level, a low level, and a high level are input to the second data voltage terminal Data_T in the t_1, t_2, and t_3 sub-periods, respectively, the element 50 to be driven emits light in the E_1 sub-period, does not emit light in the E_2 sub-period, and emits light in the E_3 sub-period. The light-emitting duration of each light-emitting sub-period is determined by the active pulse width input by the enable signal terminal EM in this period. It can be noted that the above description is based on an example in which the time control period t_n and the light-emitting period E_n both include three sub-periods. The actual number of the sub-periods is not limited to this. In a case where the current density is constant, the light-emitting time corresponds to a different gray scale. An image of a frame is formed by superimposing light-emitting sub-periods.

Based on this, the signal of the enable signal terminal EM may be a first pulse signal including a plurality of continuous pulses with different periods. The signal of the second data voltage terminal Data_T may be a second pulse signal. Then the time control sub-circuit 60 may select at least a portion of the first pulse signal as an effective signal for turning on the first output control sub-circuit according to a duty ratio of the second pulse signal so as to control the time during which the signal path is closed between the first voltage terminal V1 and the second voltage terminals V2. That is, time control of the pixel unit is realized. The pixel drive circuit provided by some embodiments of the present disclosure controls gray scales of pixels through current and time to make the element 50 to be driven (such as a Micro LED) emit light under high current density, and controls the gray scale through time to realize high brightness and high contrast.

It can be understood that the first data signal provided by the first data voltage terminal Data_I may be a fixed high level signal that enables the element 50 to be driven to have high luminous efficiency. In this case, the pixel drive circuit controls the gray scale mainly through the time control sub-circuit 60. Or, a potential of the first data signal may be changed within a certain interval range, and the first data signal within the voltage interval range ensures that the element 50 to be driven has the high luminous efficiency. In this case, the pixel drive circuit controls the gray scale through the first data voltage terminal Data_I and the second data voltage terminal Data_T in the time control sub-circuit 60.

Figure 16:
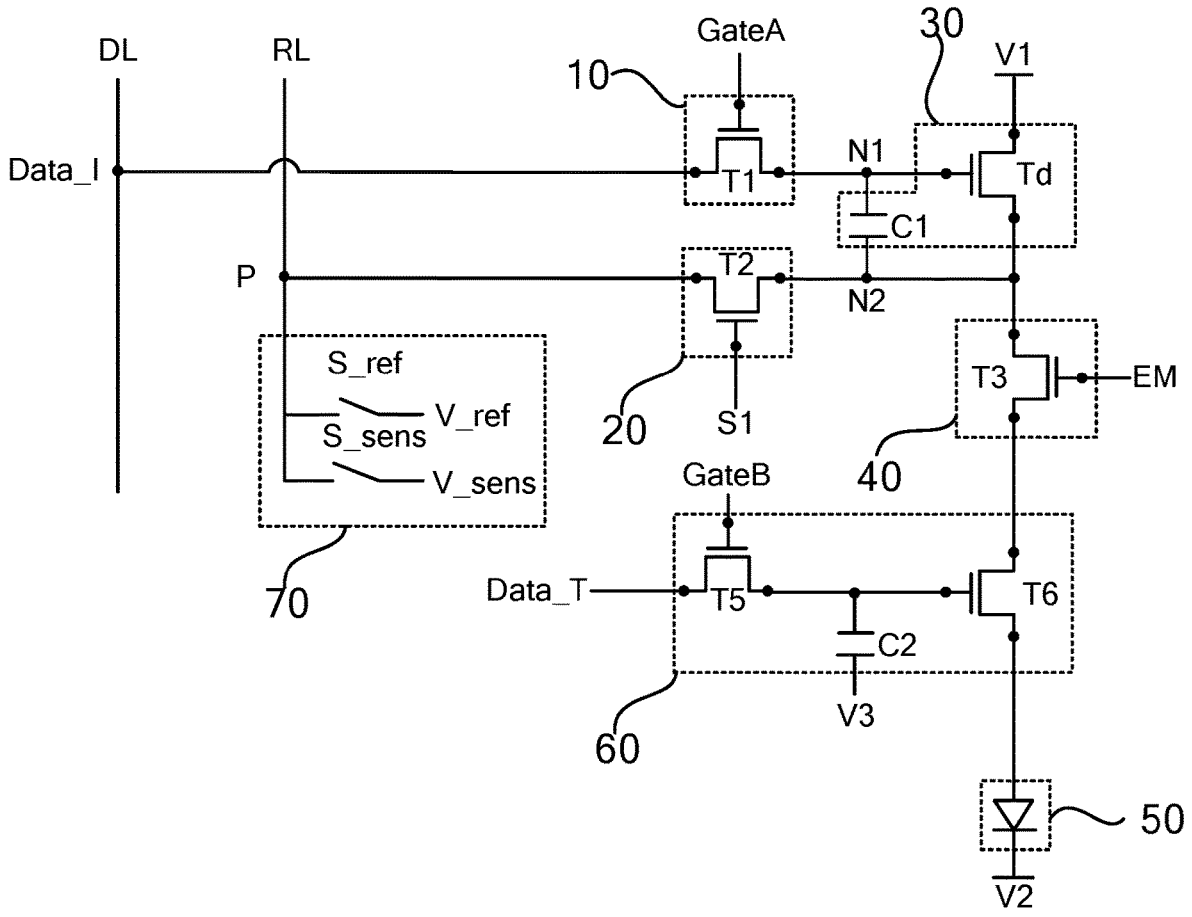
FIG. 16 is an equivalent circuit diagram showing a case in which a transmission circuit is coupled to a pixel unit, in accordance with some embodiments.

In some embodiments of the present disclosure, a threshold voltage compensation method may be provided based on a structure shown in FIG. 16. For example, an external compensation method compensates the threshold voltage of the pixel drive circuit in a non-display period of the pixel unit.

The external compensation requires a transmission circuit 70 in structure. One implementation of the transmission circuit 70 is as shown in FIG. 16. The transmission circuit 70 includes two switching elements S_ref and S_sens in the DDIC that are coupled to a read signal line RL, and coupled to the signal transmission terminal P through the read signal line RL. The transmission circuit 70 is configured to input an initialization signal to the signal transmission terminal P through the read signal line RL when the pixel drive circuit in the pixel unit is in the write period. The transmission circuit 70 is further configured to read the signal of the signal transmission terminal through the read signal line RL when the pixel drive circuit is in the threshold voltage read period.

Figure 17:
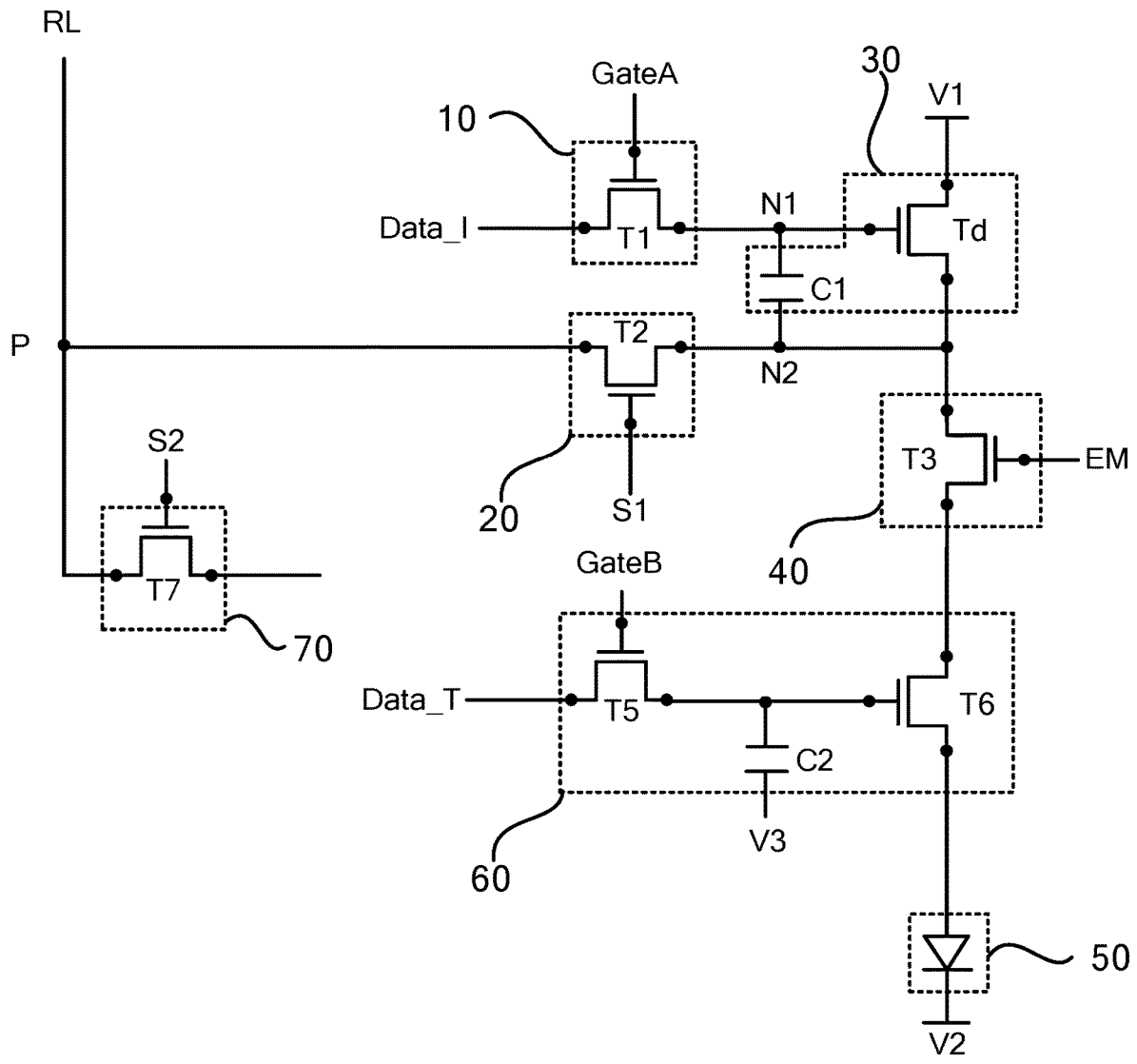
FIG. 17 is an equivalent circuit diagram showing a case in which another transmission circuit is coupled to the pixel unit, in accordance with some embodiments.

The transmission circuit 70 may include an seventh transistor T7 in the array substrate 200 as shown in FIG. 17. A gate of the seventh transistor T7 is coupled to the second signal terminal S2, and a first electrode of the seventh transistor T7 is coupled to the read signal line RL, and a second electrode of the seventh transistor T7 is configured to receive the initialization signal when the pixel drive circuit is in the write period. The second electrode of the seventh transistor T7 is further configured to output a signal of the read signal line when the pixel drive circuit is in the threshold voltage read period.

Figure 18:
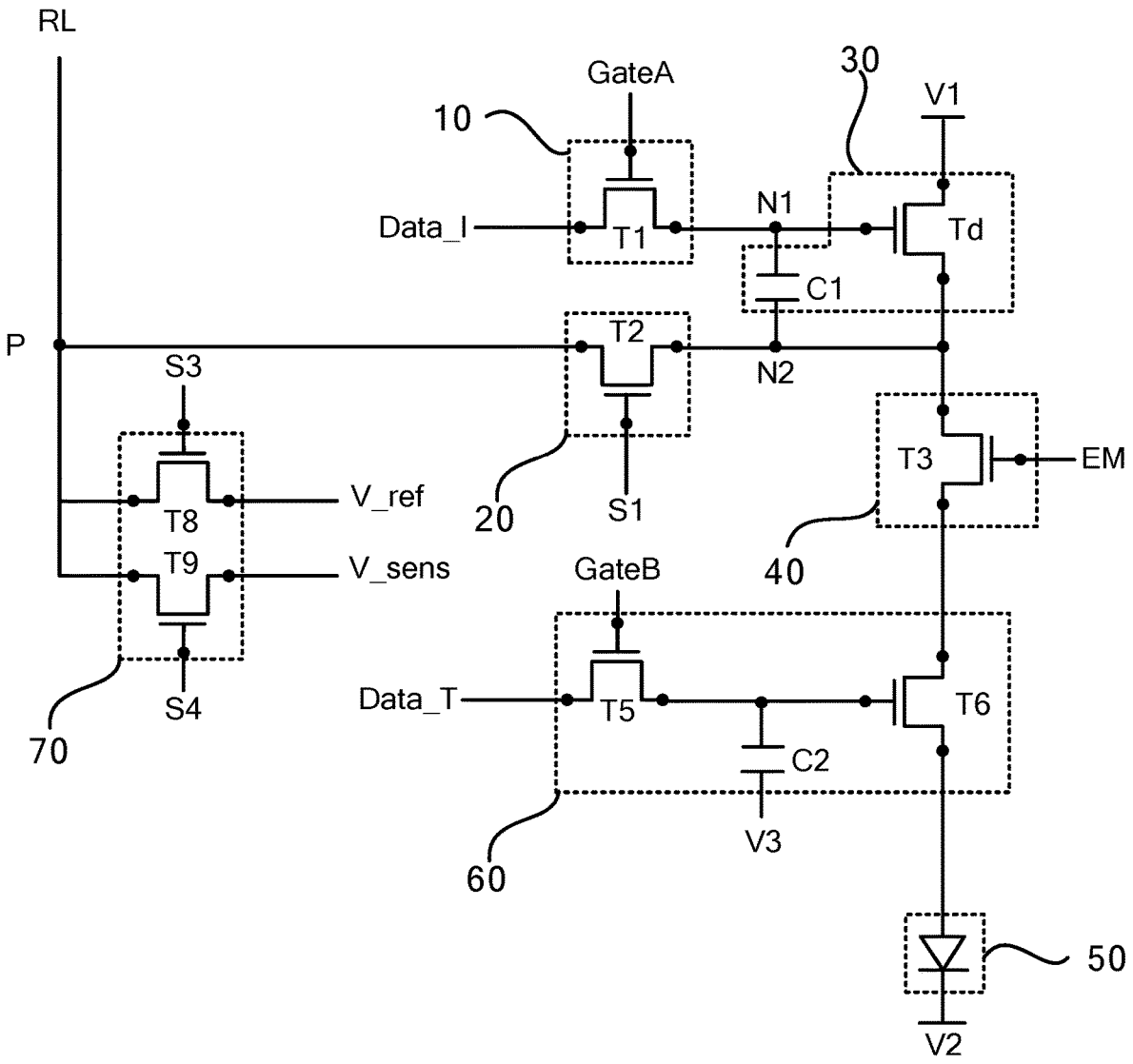
FIG. 18 is an equivalent circuit diagram showing a case in which yet another transmission circuit is coupled to the pixel unit, in accordance with some embodiments.

In order to reduce requirements for the integrated circuit, in some embodiments, as shown in FIG. 18, the transmission circuit 70 includes an eighth transistor T8 and a ninth transistor T9 that are in the array substrate 200.

A gate of the eighth transistor T8 is coupled to the third signal terminal S3, a first electrode of the eighth transistor T8 is coupled to the read signal line RL, and a second electrode of the eighth transistor T8 is configured to receive the initialization signal when the pixel drive circuit is in the write period.

A gate of the ninth transistor T9 is coupled to the fourth signal terminal S4, a first electrode of the ninth transistor T9 is coupled to the read signal line RL, and a second electrode of the ninth transistor T9 is configured to output the signal of the read signal line RL when the pixel drive circuit is in the threshold voltage read period.

Figure 19:
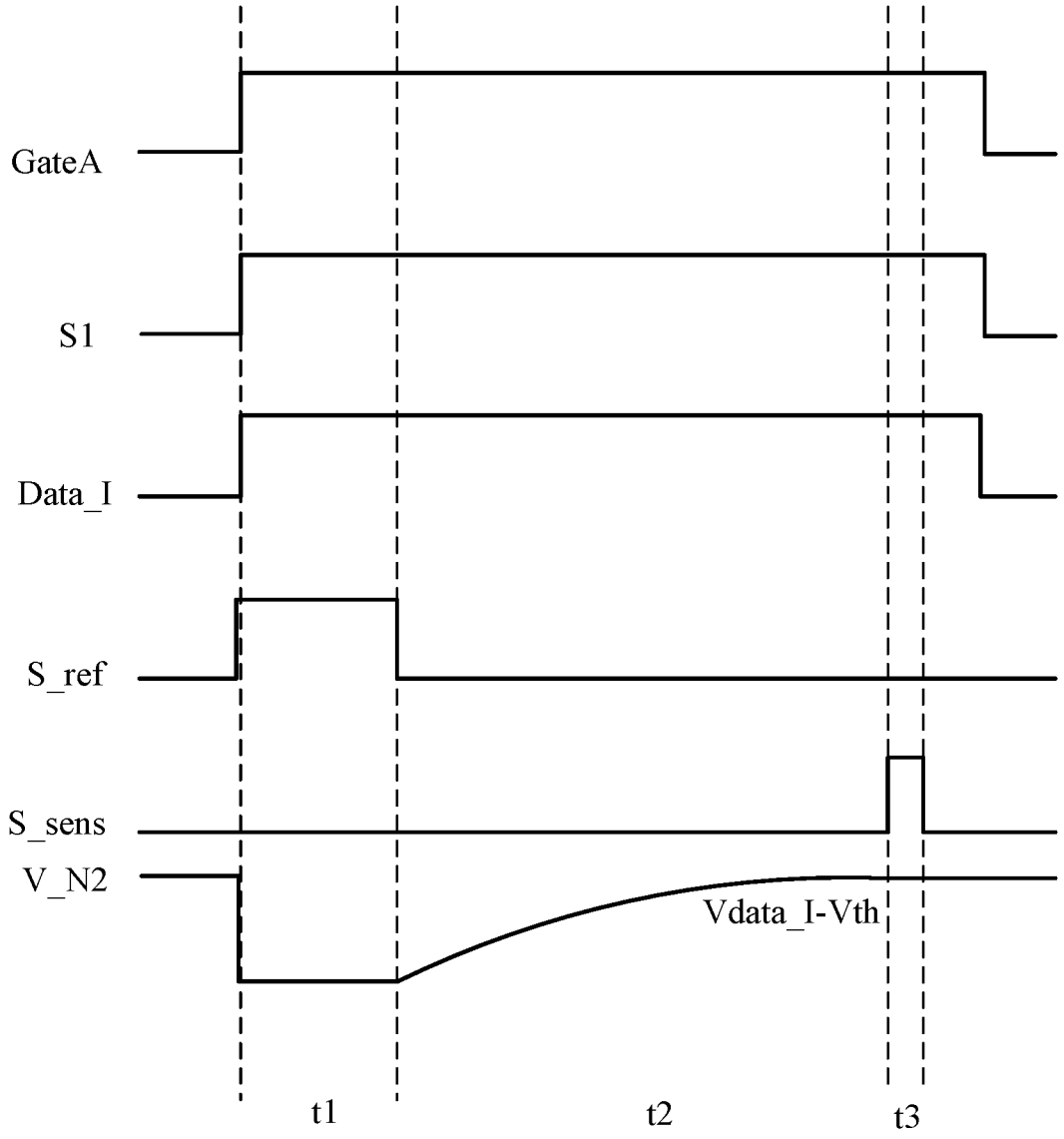
FIG. 19 is a timing diagram of driving the pixel unit shown in FIG. 16.

FIG. 19 is a timing control diagram of the pixel drive circuit provided by some embodiments of the present disclosure when the threshold voltage is compensated externally. A process of externally compensating the threshold voltage of the pixel drive circuit shown in FIG. 16 will be described in detail below in combination with FIG. 19.

In the non-display period other than the display period, the compensation process of the threshold voltage of the pixel drive circuit includes: an initialization period t1, a threshold voltage write period t2, and a threshold voltage read period t3.

First, the data write sub-circuit 10 transmits the data signal input from the first data voltage terminal Data_I to the first node N1 under the control of the turn-on signal transmitted by the first scan signal terminal GateA.

In the initialization period t1, the signal transmission terminal P receives the initialization signal, and the input and read sub-circuit 20 transmits the initialization signal to the second node N2 under the control of the turn-on signal transmitted by the first signal terminal S1 to initialize the second node N2.

Figure 20:
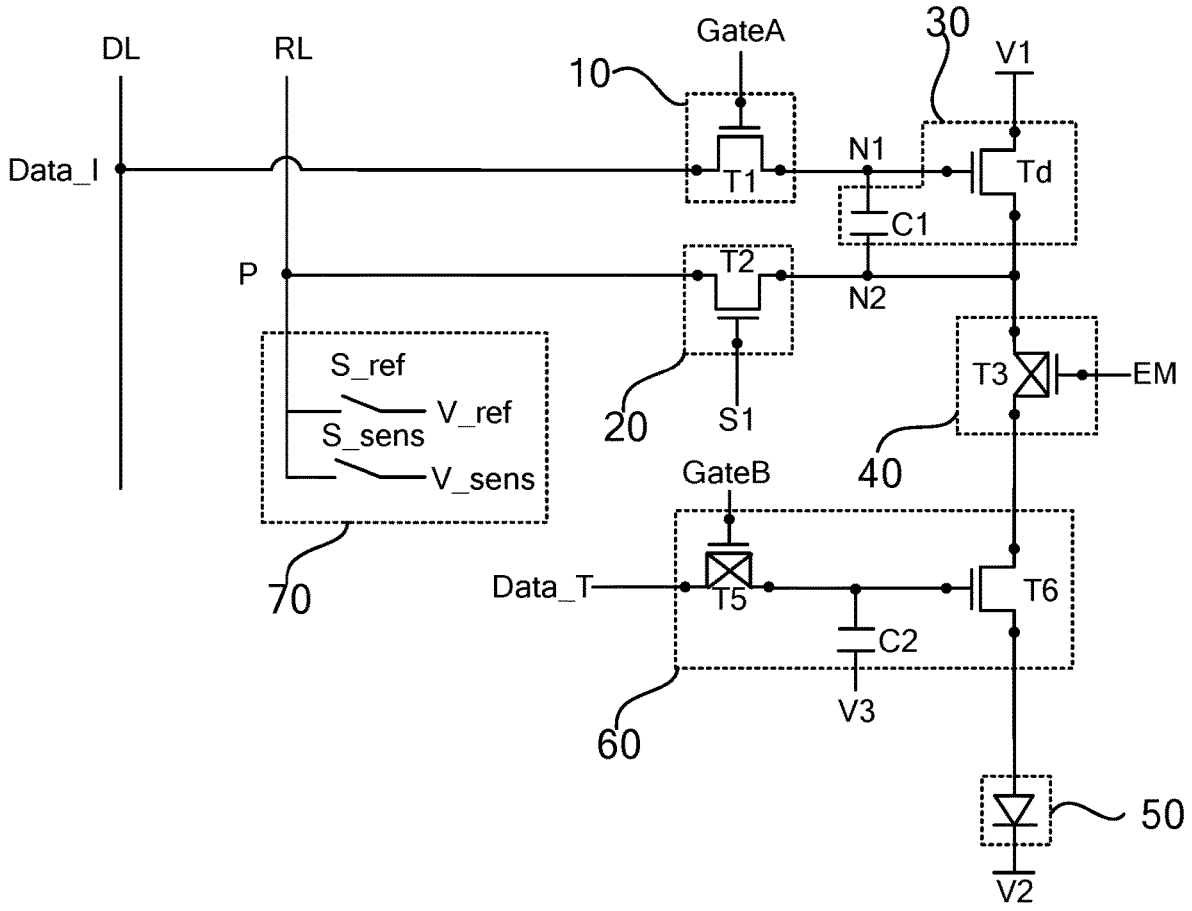
FIG. 20 is a driving state diagram of the pixel unit shown in FIG. 16.

As shown in FIG. 20 (an equivalent circuit diagram of the pixel drive circuit shown in FIG. 16 in the initialization period t1), S_ref is turned on at high level. The data write sub-circuit 10 includes the first transistor T1. A high level turn-on signal is input to the first scan signal terminal GateA, then the first transistor T1 is turned on, and the voltage of the first data voltage terminal Data_I is transmitted to the first node N1 through the first transistor. The input and read sub-circuit 20 includes the second transistor T2. A high level turn-on signal is input to the first signal terminal S1, then the second transistor T2 is turned on, and the initialization voltage V_ref is transmitted to the second node N2 through the second transistor for initialization.

In the threshold voltage write period t2, the signal transmission terminal P stops receiving the initialization signal. The first voltage terminal V1 transmits a display data signal and the threshold voltage of the drive sub-circuit to the second node N2 through the drive sub-circuit 30.

As shown in FIG. 20, S_ref is in a low level turn-off state, and the signal transmission terminal P stops receiving the initialization signal. The data write sub-circuit 10 includes the first transistor T1. The high level turn-on signal is input to the first scan signal terminal GateA, then the first transistor T1 is turned on, and the voltage of the first data voltage terminal Data_I is transmitted to the first node N1 through the first transistor. The first voltage terminal V1 lifts the potential of the second node N2 through the drive transistor Td of the drive sub-circuit 30. When a difference between the potential the first node N1 and the potential of the second node N2 is reduced to the threshold voltage of the drive transistor Td, the drive transistor Td is turned off. In this case, the voltage of the second node N2 is V_N2, which is equal to Vdata_I minus Vth (V_N2=Vdata_I−Vth).

In the threshold voltage read period t3, the signal transmission terminal P receives the voltage of the second node N2 to obtain the threshold voltage, and to generate a compensated display data signal.

The data write sub-circuit 10 transmits the compensated display data signal input from the data voltage terminal to the first node N1 under the control of the turn-on signal transmitted by the first scan signal terminal GateA.

Figure 21:
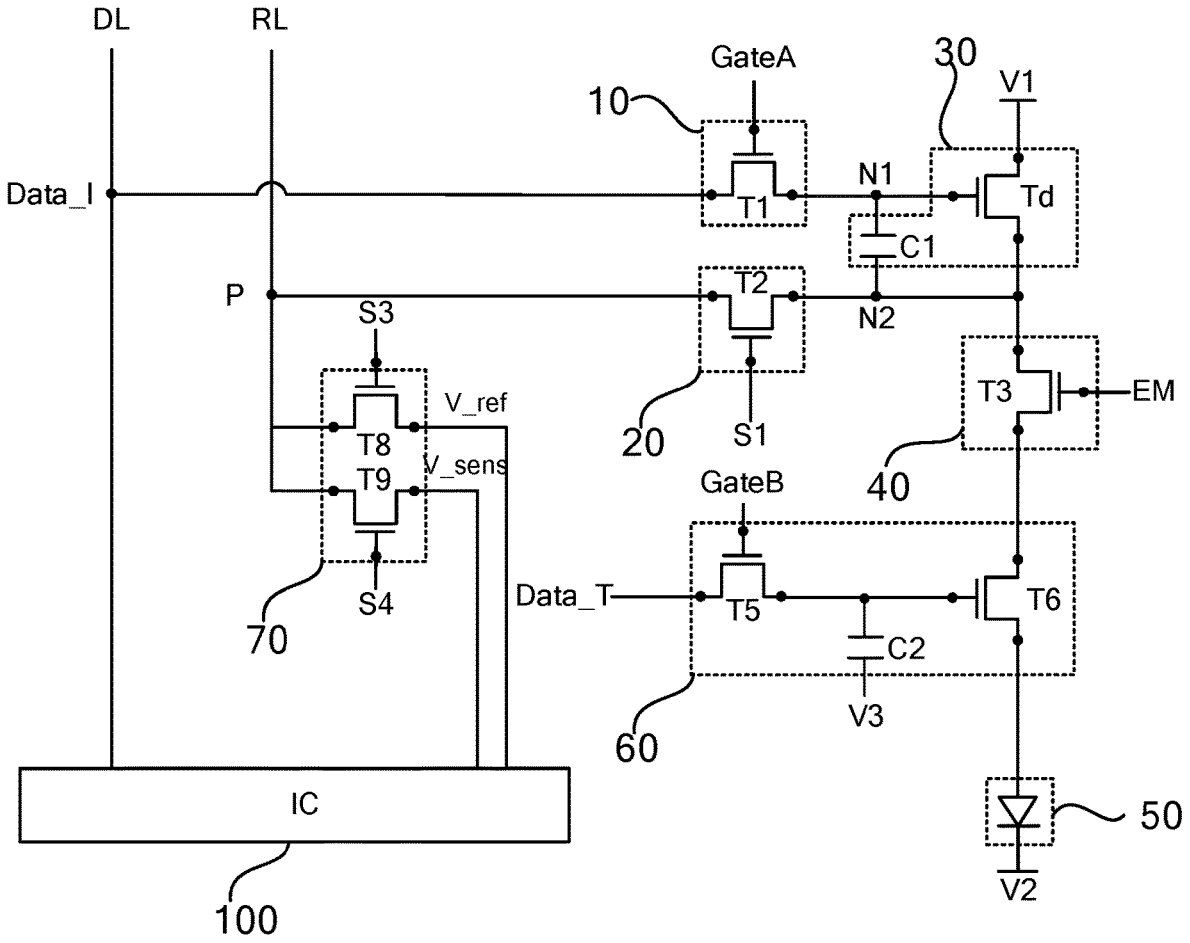
FIG. 21 is an equivalent circuit diagram showing a case in which an integrated circuit is coupled to an array substrate, in accordance with some embodiments.

As shown in FIG. 20, the input and read sub-circuit 20 includes the second transistor T2. The high level turn-on signal is input to the first signal terminal S1, and the second transistor T2 is turned on. When S_sens is turned on, an external circuit may obtain the voltage of the second node N2. Here, the threshold voltage may be obtained and compensated by the external circuit. For example, as shown in FIG. 21, the data line DL and the read signal line RL are coupled to the IC 100 (e.g., DDIC). The DDIC receives the signal from the read signal line RL, obtains the threshold voltage of the drive sub-circuit 30, generates the compensated data signal, and transmits the compensated data signal to the data write sub-circuit through the data line DL.

The driving method provided by the embodiments of the present disclosure compensates the threshold voltage of the drive transistor in the non-display period through the external compensation, which does not affect display time of the pixel drive circuit, thereby increasing light-emitting modulation time, improving maximum luminous brightness and the number of gray scales of the display apparatus under a same condition, and improving the contrast.

The foregoing descriptions are merely specific implementation manners of the present disclosure, but the protection scope of the present disclosure is not limited thereto. And any changes or replacements that a person skilled in the art could conceive of within the technical scope of the present disclosure shall be included in the protection scope of the present disclosure. Therefore, the protection scope of the present disclosure shall be subject to the protection scope of the claims.

What is claimed is:

1. An array substrate, comprising a plurality of read signal lines, a plurality of transmission circuits, and a plurality of pixel units arranged in a matrix; wherein each of the plurality of pixel units comprises a pixel drive circuit and an element to be driven, wherein the pixel drive circuit comprises a data write sub-circuit, an input and read sub-circuit, a drive sub-circuit, and a first output control sub-circuit;

wherein the data write sub-circuit is coupled to a first node, a first scan signal terminal, and a first data voltage terminal, and the data write sub-circuit is configured to transmit data signals input from the first data voltage terminal at different times to the first node under control of a turn-on signal transmitted by the first scan signal terminal;

wherein the input and read sub-circuit is coupled to a second node, a first signal terminal and a signal transmission terminal, and the input and read sub-circuit is configured to: transmit a signal of the signal transmission terminal to the second node under control of a turn-on signal transmitted by the first signal terminal in a write period, and transmit an electrical signal of the second node to the signal transmission terminal under the control of the turn-on signal transmitted by the first signal terminal in a threshold voltage read period;

wherein the drive sub-circuit is coupled to the first node, the second node, and a first voltage terminal, and the drive sub-circuit is configured to output a drive signal under control of a signal of the first node, a signal of the second node, and a signal of the first voltage terminal; and wherein the first output control sub-circuit is coupled to the drive sub-circuit and an enable signal terminal, and the first output control sub-circuit is configured to: be coupled to an element to be driven, and transmit the drive signal output by the drive sub-circuit to the element to be driven under control of a turn-on signal transmitted by the enable signal terminal; and the element to be driven is coupled to a second voltage terminal and the first output control sub-circuit of the pixel drive circuit, and the element to be driven is configured to emit light under driving of the drive signal output by the pixel drive circuit through a signal path closed between the first voltage terminal and the second voltage terminal;

signal transmission terminals of pixel units located in a same column are coupled to a read signal line of the plurality of read signal lines, and the read signal line is coupled to a transmission circuit of the plurality of transmission circuits; and the transmission circuit is configured to: input an initialization signal to a signal transmission terminal of each pixel unit of the pixel units located in the same column through the read signal line in the write period, and read a signal from the signal transmission terminal through the read signal line in the threshold voltage read period, wherein the transmission circuit includes a seventh transistor; wherein a gate of the seventh transistor is coupled to a second signal terminal, a first electrode of the seventh transistor is coupled to the read signal line, a second electrode of the seventh transistor is configured to: receive the initialization signal under control of a signal of the second signal terminal in the write period, and output the signal of the read signal line in the threshold voltage read period; or the transmission circuit includes an eighth transistor and a ninth transistor; wherein a gate of the eighth transistor is coupled to a third signal terminal, a first electrode of the eighth transistor is coupled to the read signal line, and a second electrode of the eighth transistor is configured to receive the initialization signal under control of a signal of the third signal terminal in the write period; and a gate of the ninth transistor is coupled to a fourth signal terminal, a first electrode of the ninth transistor is coupled to the read signal line, and a second electrode of the ninth transistor is configured to output the signal of the read signal line under control of a signal of the fourth signal terminal in the threshold voltage read period.

2. A display apparatus, comprising the array substrate according to claim 1 and an integrated circuit coupled to the read signal lines in the array substrate; wherein the array substrate further includes a plurality of data lines coupled to the integrated circuit; and in the array substrate, data write sub-circuits of the pixel units located in the same column are coupled to a data line of the plurality of data lines; and the integrated circuit is configured to: receive a signal of the read signal line, obtain a threshold voltage of a drive sub-circuit in the pixel unit, generate a compensated data signal, and transmit the compensated data signal to the data write sub-circuit through the data line in the threshold voltage read period.

3. The display apparatus according to claim 2, wherein the array substrate further includes a plurality of first scan signal lines, a plurality of enable signal lines and a plurality of second scan signal lines; wherein pixel drive circuits of pixel units located in a same row are coupled to a same first scan signal line, a same enable signal line, and a same second scan signal line.

4. A method of driving an array substrate, wherein the array substrate includes a plurality of read signal lines, a plurality of transmission circuits, and a plurality of pixel units arranged in a matrix; each pixel unit includes a pixel drive circuit and an element to be driven; wherein the pixel drive circuit includes a data write sub-circuit, an input and read sub-circuit, a drive sub-circuit, and a first output control sub-circuit and a time control sub-circuit; wherein the data write sub-circuit is coupled to a first node, a first scan signal terminal and a first data voltage terminal; the input and read sub-circuit is coupled to a second node, a first signal terminal and a signal transmission terminal; the drive sub-circuit is coupled to the first node, the second node and a first voltage terminal; the first output control sub-circuit is coupled to the drive sub-circuit, the element to be driven and an enable signal terminal; and the time control sub-circuit is coupled to a second scan signal terminal, a third voltage terminal, a second data voltage terminal, the first output control sub-circuit and the element to be driven; and the element to be driven is coupled to the first output control sub-circuit and a second voltage terminal;

wherein signal transmission terminals of pixel units located in a same column are coupled to a read signal line of the plurality of read signal lines, and the read signal line is coupled to a transmission circuit of the plurality of transmission circuits;

the transmission circuit includes a seventh transistor, a gate of the seventh transistor is coupled to a second signal terminal, and a first electrode of the seventh transistor is coupled to the read signal line; or the transmission circuit includes an eighth transistor and a ninth transistor; a gate of the eighth transistor is coupled to a third signal terminal, a first electrode of the eighth transistor is coupled to the read signal line; a gate of the ninth transistor is coupled to a fourth signal terminal, a first electrode of the ninth transistor is coupled to the read signal line;

a display period of the array substrate includes a write period, a time control period, and a light-emitting period, the method comprises:

in the write period, transmitting, by the data write sub-circuit, a data signal input from the first data voltage terminal to the first node under control of a turn-on signal transmitted by the first scan signal terminal; and transmitting, by the input and read sub-circuit, a signal of the signal transmission terminal to the second node under control of a turn-on signal transmitted by the first signal terminal to initialize the second node;

in the time control period, storing, by the time control sub-circuit, a signal of the second data voltage terminal under control of a turn-on signal transmitted by the second scan signal terminal; and in the light-emitting period, outputting, by the drive sub-circuit, a drive signal under control of a signal of the first node, a signal of the second node, and a signal of the first voltage terminal;

controlling, by the time control sub-circuit, an operating time of the first output control sub-circuit and the element to be driven according to the signal of the second data voltage terminal, so as to control a time during which a signal path is closed between the first voltage terminal and the second voltage terminal; and receiving, by the element to be driven, the drive signal transmitted in the signal path to emit light under driving of the drive signal;

wherein a non-display period other than the display period of the array substrate includes an initialization period, a threshold voltage write period, and a threshold voltage read period, the method further comprises:

in the initialization period, inputting, by the transmission circuit with the seventh transistor being turned on, an initialization signal to the signal transmission terminal through the read signal line under control of a signal of the second signal terminal; or, inputting, by the transmission circuit with the eighth transistor being turned on, an initialization signal to the signal transmission terminal through the read signal line under control of a signal of the third signal terminal;

receiving, by the signal transmission terminal, the initialization signal; and transmitting, by the input and read sub-circuit, the initialization signal to the second node under the control of the turn-on signal transmitted by the first signal terminal to initialize the second node;

in the threshold voltage write period, stopping, by the signal transmission terminal, receiving the initialization signal; and transmitting, by the first voltage terminal, a display data signal and a threshold voltage of the drive sub-circuit to the second node through the drive sub-circuit; and in the threshold voltage read period, receiving, by the signal transmission terminal, a voltage of the second node;

reading, by the transmission circuit with the seventh transistor being turned on, the voltage from the signal transmission terminal through the read signal line under control of the signal of the second signal terminal to obtain the threshold voltage and generate a compensated display data signal; or, reading, by the transmission circuit with the ninth transistor being turned on, the voltage from the signal transmission terminal through the read signal line under control of a signal of the fourth signal terminal to obtain the threshold voltage and generate a compensated display data signal; and transmitting, by the data write sub-circuit, the compensated display data signal input from the data voltage terminal to the first node under the control of the turn-on signal transmitted by the first scan signal terminal.

5. The method according to claim 4, wherein a signal of the enable signal terminal is a first pulse signal including a plurality of continuous pulses with different periods, and the signal of the second data voltage terminal is a second pulse signal;

controlling, by the time control sub-circuit, the operating time of the first output control sub-circuit and the element to be driven according to the signal of the second data voltage terminal includes:

selecting, by the time control sub-circuit, at least a portion of the first pulse signal as an effective signal for turning on the first output control sub-circuit according to a duty ratio of the second pulse signal, so as to control the time during which the signal path is closed between the first voltage terminal and the second voltage terminal.

6. A method of driving an array substrate, wherein the array substrate includes a plurality of read signal lines, a plurality of transmission circuits, and a plurality of pixel units arranged in a matrix; each pixel unit includes a pixel drive circuit and an element to be driven; wherein the pixel drive circuit includes a data write sub-circuit, an input and read sub-circuit, a drive sub-circuit and a first output control sub-circuit; wherein the data write sub-circuit is coupled to a first node, a first scan signal terminal and a first data voltage terminal; the input and the read sub-circuit is coupled to a second node, a first signal terminal and a signal transmission terminal; the drive sub-circuit is coupled to the first node, the second node and a first voltage terminal, and the first output control sub-circuit is coupled to the drive sub-circuit, the element to be driven and an enable signal terminal; and the element to be driven is coupled to the first output control sub-circuit and a second voltage terminal;

wherein signal transmission terminals of pixel units located in a same column are coupled to a read signal line of the plurality of read signal lines, and the read signal line is coupled to a transmission circuit of the plurality of transmission circuits;

the transmission circuit includes a seventh transistor, a gate of the seventh transistor is coupled to a second signal terminal, and a first electrode of the seventh transistor is coupled to the read signal line; or the transmission circuit includes an eighth transistor and a ninth transistor; a gate of the eighth transistor is coupled to a third signal terminal, a first electrode of the eighth transistor is coupled to the read signal line; a gate of the ninth transistor is coupled to a fourth signal terminal, a first electrode of the ninth transistor is coupled to the read signal line;

the method comprises:

in an initialization period, transmitting, by the data write sub-circuit, a first initialization data signal input from the first data voltage terminal to the first node under control of a turn-on signal transmitted by the first scan signal terminal;

inputting, by the transmission circuit with the seventh transistor being turned on, a second initialization data signal to the signal transmission terminal through the read signal line under control of a signal of the second signal terminal; or, inputting, by the transmission circuit with the eighth transistor being turned on, a second initialization data signal to the signal transmission terminal through the read signal line under control of a signal of the third signal terminal; and transmitting, by the input and read sub-circuit, the second initialization data signal input from the signal transmission terminal to the second node under control of a turn-on signal transmitted by the first signal terminal;

in a threshold voltage read period, transmitting, by the data write sub-circuit, a first data signal input from the first data voltage terminal to the first node under the control of the turn-on signal transmitted by the first scan signal terminal;

transmitting, by the input and read sub-circuit, an electrical signal of the second node to the signal transmission terminal under the control of the turn-on signal transmitted by the first signal terminal; and reading, by the transmission circuit with the seventh transistor being turned on, the electrical signal from the signal transmission terminal through the read signal line under control of the signal of the second signal terminal; or, reading, by the transmission circuit with the ninth transistor being turned on, the electrical signal from the signal transmission terminal through the read signal line under control of a signal of the fourth signal terminal;

in a threshold voltage compensation period, transmitting, by the data write sub-circuit, a second data signal input from the first data voltage terminal to the first node under the control of the turn-on signal transmitted by the first scan signal terminal;

storing the second data signal in the drive sub-circuit, wherein the second data signal is a signal obtained by compensating the first data signal;

receiving, by the signal transmission terminal, a signal of the second voltage terminal; and transmitting, by the input and read sub-circuit, a potential signal input from the signal transmission terminal to the second node under the control of the turn-on signal transmitted by the first signal terminal; and in a light-emitting period, controlling, by the first output control sub-circuit, a signal path to be closed between the first voltage terminal and the second voltage terminal under control of a turn-on signal transmitted by the enable signal terminal;

transmitting, by the first output control sub-circuit, a signal of the first voltage terminal to the drive sub-circuit;

outputting, by the drive sub-circuit, a drive signal under control of a signal of the first node, a signal of the second node, and the signal of the first voltage terminal; and receiving, by the element to be driven, the drive signal transmitted in the signal path to emit light under driving of the drive signal.

7. The array substrate according to claim 1, the pixel drive circuit further comprising:

a time control sub-circuit coupled to a second scan signal terminal, a third voltage terminal, a second data voltage terminal, and the first output control sub-circuit; wherein the time control sub-circuit is configured to: be coupled to the element to be driven, store a signal of the second data voltage terminal under control of a turn-on signal transmitted by the second scan signal terminal, and control an operating time of the first output control sub-circuit and the element to be driven according to the signal of the second data voltage terminal.

8. The array substrate according to claim 7, wherein the time control sub-circuit includes a fifth transistor, a sixth transistor and a second storage capacitor; wherein a gate of the fifth transistor is coupled to the second scan signal terminal, a first electrode of the fifth transistor is coupled to the second data voltage terminal, and a second electrode of the fifth transistor is coupled to a first terminal of the second storage capacitor and a gate of the sixth transistor;

a first electrode of the sixth transistor is coupled to the first output control sub-circuit, and a second electrode of the sixth transistor is configured to be coupled to the element to be driven; and a second terminal of the second storage capacitor is coupled to the third voltage terminal.

9. The array substrate according to claim 1, wherein the first output control sub-circuit includes a third transistor; wherein a gate of the third transistor is coupled to the enable signal terminal, a first electrode of the third transistor is coupled to the drive sub-circuit, and a second electrode of the third transistor is configured to be coupled to the element to be driven.

10. The array substrate according to claim 1, the pixel drive circuit further comprising:

a second output control sub-circuit coupled to the first voltage terminal, the drive sub-circuit and the enable signal terminal, the second output control sub-circuit configured to transmit the signal of the first voltage terminal to the drive sub-circuit under the control of the turn-on signal transmitted by the enable signal terminal.

11. The array substrate according to claim 10, wherein the second output control sub-circuit includes a fourth transistor; wherein a gate of the fourth transistor is coupled to the enable signal terminal, a first electrode of the fourth transistor is coupled to the first voltage terminal, and a second electrode of the fourth transistor is coupled to the drive sub-circuit.

12. The array substrate according to claim 1, wherein the data write sub-circuit includes a first transistor; wherein a gate of the first transistor is coupled to the first scan signal terminal, a first electrode of the first transistor is coupled to the first data voltage terminal, and a second electrode of the first transistor is coupled to the first node.

13. The array substrate according to claim 1, wherein the input and read sub-circuit includes a second transistor; wherein a gate of the second transistor is coupled to the first signal terminal, a first electrode of the second transistor is coupled to the signal transmission terminal, and a second electrode of the second transistor is coupled to the second node.

14. The array substrate according to claim 1, wherein the drive sub-circuit includes a first storage capacitor and a drive transistor; wherein a first terminal of the first storage capacitor is coupled to the first node, and a second terminal of the first storage capacitor is coupled to the second node; and a gate of the drive transistor is coupled to the first node, a first electrode of the drive transistor is coupled to the first voltage terminal, and a second electrode of the drive transistor is coupled to the second node and the first output control sub-circuit.

15. The array substrate according to claim 1, wherein the element to be driven includes a light-emitting diode.

16. The array substrate according to claim 10, wherein the drive sub-circuit includes a first storage capacitor and a drive transistor; wherein a first terminal of the first storage capacitor is coupled to the first node, and a second terminal of the first storage capacitor is coupled to the second node;

a gate of the drive transistor is coupled to the first node; and a first electrode of the drive transistor is coupled to the second output control sub-circuit, and a second electrode of the drive transistor is coupled to the second node and the first output control sub-circuit; or a first electrode of the drive transistor is coupled to the second node and the second output control sub-circuit, and a second electrode of the drive transistor is coupled to the first output control sub-circuit.

* * * * *